United States Patent [19]

Kato

[11] Patent Number: 4,977,049

[45] Date of Patent: Dec. 11, 1990

[54] ELECTROPHOTOGRAPHIC LITHOGRAPHIC PRINTING PLATE PRECURSOR

[75] Inventor: Eiichi Kato, Shizuoka, Japan

[73] Assignee: Fuji Photo Film Co., Ltd., Kanagawa, Japan

[21] Appl. No.: 306,418

[22] Filed: Feb. 6, 1989

[30] Foreign Application Priority Data

Feb. 4, 1988 [JP] Japan ..... 63-22839

[51] Int. Cl.[5] ..... G03G 5/087

[52] U.S. Cl. ..... 430/49; 430/87; 430/96

[58] Field of Search ..... 430/49, 87, 96

[56] References Cited

U.S. PATENT DOCUMENTS 4,101,326 7/1978 Barkey ..... 430/286

4,828,952 5/1989 Kato et al. ..... 430/87

*Primary Examiner*—John L. Goodrow

*Attorney, Agent, or Firm*—Sughrue, Mion, Zinn, Macpeak & Seas

[57] ABSTRACT

An electrophotographic lithographic printing plate precursor having an electrophotographic photoreceptor which has at least one photoconductive layer containing a photoconductive zinc oxide and a resin binder on a conductive support, wherein the resin binder contains at least one resin which has at least one functional group capable of forming at least one group selected from a thiol group, a phospho group, an amino group and a sulfo group by decomposition and at least a part of which has been crosslinked.

14 Claims, No Drawings

ELECTROPHOTOGRAPHIC LITHOGRAPHIC PRINTING PLATE PRECURSOR

FIELD OF THE INVENTION

This invention relates to an electrophotographic lithographic printing plate to be prepared by electrophotographic system, and, more particularly, to an improvement in a resin binder forming a photoconductive layer of the lithographic printing plate precursor.

BACKGROUND OF THE INVENTION

A number of offset printing plate precursors for directly producing printing plates have hitherto been proposed, and some of them have already been put into practical use. Widely employed among them is a system in which a photoreceptor comprising a conductive support having thereon a photoconductive layer mainly comprising photoconductive particles, e.g., zinc oxide, and a resin binder is subjected to ordinary electrophotographic processing to form a highly lipophilic toner image thereon and the surface of the photoreceptor is then treated with an oil-desensitizing solution, referred to as an etching solution to selectively render non-image areas hydrophilic, to thus obtain an offset printing plate.

Requirements of offset printing plate precursors for obtaining satisfactory prints include: (1) the original should be reproduced faithfully on the photoreceptor; (2) the surface of a photoreceptor has affinity for an oil-desensitizing solution so as to render non-image areas sufficiently hydrophilic, while, at the same time, having water resistance; and (3) that a photoconductive layer having an image formed thereon is not released during printing and is quite receptive to dampening water so that the non-image areas retain these hydrophilic properties sufficiently that freedom from stains even on printing a large number of prints exists.

It is known that these performance properties of the printing plate precursors are influenced by the ratio of zinc oxide to the resin binder in the photoconductive layer. For example, as the ratio of the resin binder to zinc oxide particles becomes small, oil-desensitization of the surface of the photoconductive layer is increased to reduce background stains, but, in turn, the internal cohesion of the photoconductive layer per se is weakened, this results in reduction of printing durability due to insufficient mechanical strength. On the other hand, as the proportion of the resin binder increases, printing durability is improved, but background staining tends to become conspicuous. With respect to background staining, while this is a phenomenon associated with the degree of oil-desensitization achieved, it has been elucidated that the oil-desensitization of the photoconductive layer surface depends not only on the zinc oxide/resin binder ratio in the photoconductive layer, but also greatly on the kind of the resin binder used.

Resin binders which have been conventionally known include silicone resins (see JP-B-No. 34-6670 (the term "JP-B No. " as used herein means an "examined Japanese patent publication"), styrene-butadiene resins (see JP-B No. 35-1950), alkyd resins, maleic acid resins, polyamides (see JP-B-No. 35-11219), vinyl acetate resins (see JP-B-No. 41-2425), vinyl acetate copolymer resins (see JP-B-No. 41-2426), acrylic resins (see JP-B-No. 35-11216), acrylic ester copolymer resins (see JP-B-No. 35-11219, JP-B No.36-8510, JP-B-No. 40-13946), etc. However, electrophotographic light-sensitive materials using these known resins suffer from any number of disadvantages, such as low charging characteristics of the photoconductive layer; poor quality of the reproduced image, particularly dot reproducibility or resolving power; low sensitivity to exposure; insufficient oil-desensitization attained by oil-desensitization for use as an offset master, which results in background stains on prints when used for offset printing; insufficient film strength of the light-sensitive layer, which causes release of the light-sensitive layer during offset printing, with a large number of prints not being possible; susceptibility of image quality to environmental influences at the time of electrophotographic image formation, such as high temperatures and high humidities; and the like.

Particularly for use as an offset printing plate precursor, formation of background stains due to insufficient oil-desensitization presents a serious problem. In order to solve this problem, development of binder resins for zinc oxide capable of, improving oil-desensitization has variously been investigated. Such resins include, for example, a resin having a molecular weight of from $1.8\times10^4$ to $1.0\times10^5$ and a glass transition point of from 10° to 80° C. obtained by copolymerizing a (meth)acrylate monomer and a copolymerizable monomer in the presence of fumaric acid in combination with a copolymer of a (meth)acrylate monomer and a copolymerizable monomer other than fumaric acid as disclosed in JP-B-No. 50-31011 a terpolymer containing a (meth)acrylic ester unit with a substituent having a carboxylic group at least 7 atoms distant from the ester linkage as disclosed in JP-A-No. 53-54027 (the term "JP-A" as used herein means an "unexamined published Japanese patent application"); a tetra- or pentapolymer containing an acrylic acid unit and a hydroxylethyl (meth)acrylate unit as disclosed in JP-A-No. 54-20735 and JP-A-No. 57-202544, a terpolymer containing a (meth)acrylic ester unit having an alkyl group having from 6 to 12 carbon atoms as a substituent and a vinyl monomer containing a carboxylic acid group as disclosed in JP-A-No. 58-68046; and the like.

Nevertheless, evaluations of these resins proposed for improving oil-desensitization indicate that none of them is fully satisfactory in terms of stain resistance, printing durability, and the like.

Further, investigation of resins containing a functional group capable of forming a hydrophilic group by decomposition as binder resins has also been conducted. Such resins include, for example, a resin containing a functional group capable of forming a hydroxyl group by decomposition (see JP-A-No. 62-195684, JP-A-No. 62-210475 and JP-A-No. 62-210476); a resin containing a functional group capable of forming a carboxyl group by decomposition (see JP-A-No. 62-21269); and the like.

These resins form a hydrophilic group by hydrolysis or hydrogenolysis with an oil-desensitizing solution or dampening water used during printing. It is disclosed that use of such resins as binder resins for lithographic printing plate precursors brings about overcoming of various problems (worsening of smoothness, worsening of electrophotographic characteristics, and so on) which would be caused by the strong interaction between the hydrophilic group and the surface of the photoconductive zinc oxide grains when a resin previously having a hydrophilic group per se is used and also further elevates the hydrophilicity of the non-image areas to be made hydrophilic by the oil-desensitizing solution because of the hydrophilic group to be formed in the resins by decomposition thereof so that the lipophilicity of the image areas may be differentiated distinctly from the hydrophilicity of the non-image areas to be able to prevent a printing ink from adhering to the non-image areas during printing, whereby, as a result, a large number of prints having a sharp image quality without background staining may be obtained.

However, even such resins have been found still unsatisfactory in terms of stain resistance and printing durability. Specifically, even when the resins containing a hydrophilic group-forming functional group as mentioned above are used, if the amount of the resin to be incorporated is made large so as to further improve the hydrophilicity thereof in the non-image areas, the resin would become highly hydrophilic and thereby soluble in water because of the hydrophilic groups formed by decomposition of the resin. Accordingly, use of such excess resins has been found problematic in terms of the durability thereof.

On this basis, development of a technique for further improving the non-image areas because of the effect of the hydrophilic group to be formed the binder resin, while also improving the durability of the resin used, is desired.

More specifically, development of a technique capable of maintaining the effect of improving the hydrophilicity in the non-image areas or capable of improving the effect even when the content of the resin having a hydrophilic group-forming functional group as mentioned above in the total resin binder is lowered, so that a large number of prints having a sharp image quality without background staining may be obtained even when the printing condition has become more severe, for example, because of use of a large-scaled printing machine or because of variation in printing pressure, is desired.

SUMMARY OF THE INVENTION

An object of the present invention is to overcome the above-mentioned problems. In accordance with the present invention, it has been found that these problems can be overcome by an electrophotographic lithographic printing plate precursor having an electrophotographic photoreceptor which has at least one photoconductive layer containing photoconductive zinc oxide and a resin binder on a conductive support, wherein the resin binder contains at least one resin which has at least one functional group capable of forming at least one group selected from a thiol group, a phosphono group, an amino group and a sulfo group by decomposition and at least a part of which has been crosslinked.

DETAILED DESCRIPTION OF THE INVENTION

A characteristic aspect of the present invention is that at least a part of the resin binder in the photoconductive layer of the lithographic printing plate precursor is a resin which has at least one functional group capable of forming at least one group selected from a thiol group, a phosphono group, an amino group and/or a sulfo group by decomposition and at least a part of which has been crosslinked. Accordingly, the lithographic printing plate precursor of the present invention has various advantages that such may form an image faithful to an original, such forms no background stains because of the high hydrophilicity in the nonimage areas, the surface smoothness and the electrostatic characteristic of the photoconductive layer are good and the printing durability is excellent.

Further, the lithographic printing plate precursor of the invention is advantageously characterized in that this does not depends upon the variation in environmental conditions of electrophotomechanical processing and has excellent storage stability before processing.

The resin containing at least one functional group capable of forming at least one hydrophilic group selected from a thiol group, a phosphono group, a sulfo group and/or an amino group by decomposition (the functional group is referred to as a "hydrophilic group-producing functional group" for, simplicity at times hereinafter) for use in the present invention will be explained in detail.

The functional group to be contained in the hydrophilic group-producing functional group-containing resin for use in the present invention forms at least one hydrophilic group by decomposition, and the number of the hydrophilic group to be formed from one functional group may be one or more.

First, the resin containing at least one functional group capable of forming at least one thiol group (13 SH) by decomposition (thiol group-producing functional group-containing resin) is described hereinafter in detail. This resin contains at least one functional group, for example, represented by the following formula (I):

$$(-S-L^{A}) \qquad \text{(I)}$$

Wherein $L^{A}$ represents

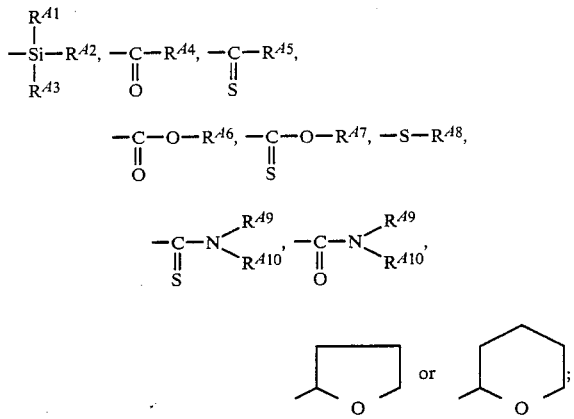

wherein $R^{A1}$, $R^{A2}$, and $R^{A3}$, which may be the same or different, each represents a hydrocarbon group or $-O-R^{A'}$ (wherein $R^{A'}$ represents a hydrocarbon group); and $R^{A4}$, $R^{A5}$, $R^{A6}$, $R^{A7}$, $R^{A8}$, $R^{A9}$, and $R^{A10}$ independently each represents a hydrocarbon group.

The functional group of the formula $(-S-L^{A})$ forms a thiol group by decomposition, which is explained in detail hereinafter.

When $L^{A}$ represents

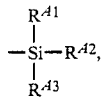

$R^{A1}$, $R^{A2}$ and $R^{A3}$ may be the same or different and each preferably represents an optionally substituted linear or branched alkyl group having from 1 to 18 carbon atoms (e.g., methyl, ethyl, propyl, butyl, hexyl, octyl, decyl, dodecyl, octadecyl, chloroethyl, methoxyethyl, methoxypropyl), an optionally substituted alicyclic group having from 5 to 8 carbon atoms (e.g., cyclopentyl, cyclohexyl), an optionally substituted aralkyl group having from 7 to 12 carbon atoms (e.g., benzyl, phenethyl, chlorobenzyl, methoxybenzyl), an optionally substituted aromatic group having from 6 to 12 carbon atoms (e.g., phenyl, naphthyl, chlorophenyl, tolyl, methoxyphenyl, methoxycarbonylphenyl, dichlorophenyl) or —O—$R^{A'}$ (in which $R^{A'}$ represents a hydrocarbon group and, for example, has the same meaning as the hydrocarbon group described for $R^{A1}$, $R^{A2}$ and $R^{A3}$). Wherein $L^A$ represents $$-\underset{\underset{O}{\|}}{C}-R^{A4},\ -\underset{\underset{S}{\|}}{C}-R^{A5},\ -\underset{\underset{O}{\|}}{C}-O-R^{A6},\ -\underset{\underset{S}{\|}}{C}-O-R^{A7},$$

or —S—$R^{A8}$; $R^{A4}$, $R^{A5}$, $R^{A6}$, $R^{A7}$ and $R^{A8}$ each preferably represents an optionally substituted linear or branched alkyl group having from 1 to 12 carbon atoms (e.g., methyl, trichloromethyl, trifluoromethyl, methoxymethyl, ethyl, propyl, n-butyl, hexyl, 3-chloropropyl, phenoxymethyl, 2,2,2-trifluoroethyl, t-butyl, hexafluoro-i-propyl, octyl, decyl), an optionally substituted aralkyl group having from 7 to 12 carbon atoms (e.g., benzyl, phenethyl, methylbenzyl, trimethylbenzyl, pentamethylbenzyl, methoxybenzyl), or an optionally substituted aryl group having from 6 to 12 carbon atoms (e.g., phenyl, nitrophenyl, cyanophenyl, methanesulfonylphenyl, methoxyphenyl, butoxyphenyl, chlorophenyl, dichlorophenyl, trifluoromethylphenyl).

When $L^A$ represents $$-\underset{\underset{S}{\|}}{C}-N\begin{matrix}R^{A9}\\R^{A10}\end{matrix}\quad\text{or}\quad -\underset{\underset{O}{\|}}{C}-N\begin{matrix}R^{A9}\\R^{A10}\end{matrix};$$

$R^{A9}$ and $R^{A10}$ may be the same or different, and preferred examples of the groups may be selected from the substituents described for $R^{A4}$ to $R^{A8}$.

Other preferred thiol group-producing functional group-containing resins for use in the present invention are resins having at least one thiirane ring, as represented by the following general formula (II) or (III):

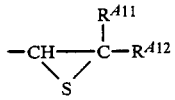

(II)

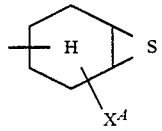

(III)

In the formula (II), $R^{A11}$ and $R^{A12}$ may be the same or different and each represents a hydrogen atom or a hydrocarbon group. Preferred examples of the groups may be selected from the substituents preferred for $R^{A4}$ to $R^{A7}$.

In the formula (III), $X^A$ represents a hydrogen atom or an aliphatic group. The aliphatic group preferably includes an alkyl group having from 1 to 6 carbon atoms (e.g., methyl, ethyl, propyl, butyl).

Still other preferred thiol group-producing functional group-containing resins for use in the present invention are resins containing at least one sulfur atom-containing heterocyclic group, as represented by the following general formula (IV).

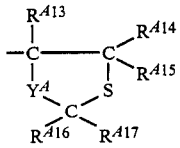

(IV)

In the formula (IV), $Y^A$ represents an oxygen atom or —NH—.

$R^{A13}$, $R^{A14}$ and $R^{A15}$ may be the same or different and each represents a hydrogen atom or a hydrocarbon group. Preferably, these each represent a hydrogen atom or the group preferred for $R^{A4}$ to $R^{A7}$.

$R^{A16}$ and $R^{A17}$ may be the same or different and each represents a hydrogen atom, a hydrocarbon group or —O—$R^{A''}$ (in which R'' represents a hydrocarbon group). Preferably, these each represents the group preferred for $R^{A1}$ to $R^{A3}$.

In accordance with still another preferred embodiment of the present invention, the thiol group-producing functional group-containing resins for use in the present invention are resins having at least one functional group composed of at least two thiol groups which are stereostructurally adjacent each other and are protected by one protective group.

Examples of functional groups composed of at least two thiol groups which are stereostructurally adjacent each other and are protected by one protective group, are the following groups of formulae (V), (VI) and (VII)

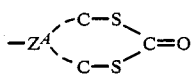

(V)

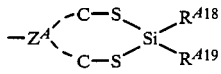

(VI)

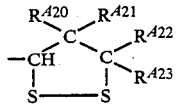

(VII)

In the formulae (V) and (VI), $Z^A$ represents an optionally hetero atom-interrupted carbon carbon linkage or represents a chemical bond directly bonding the two C-S bonds in the formulae, provided that the number of the atoms between the sulfur atoms is 4 or less. Further, one Of the —($Z^A$ . . . C)—bonds may represent a mere bond only, for example, as follows.

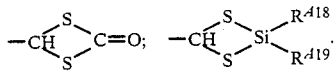

In the formula (VI), $R^{A18}$ and $R^{A19}$ may be the same or different and each represents a hydrogen atom, a hydrocarbon group or —O—$R^{A''}$ (in which $R^{A''}$ represents a hydrocarbon group).

Preferably, $R^{A18}$ and $R^{A19}$ may be the same or different and each represents a hydrogen atom, an optionally substituted alkyl group having from 1 to 12 carbon atoms (e.g., methyl, ethyl, propyl, butyl, hexyl, 2-methoxyethyl, octyl), an optionally substituted aralkyl group having from 7 to 12 carbon atoms (e.g., benzyl phenetyl, methylbenzyl, methoxybenzyl, chlorobenzyl), an alicyclic group having from 5 to 8 carbon atoms (e.g., cyclopentyl, cyclohexyl), an optionally substituted aryl group having from 6 to 12 carbon atoms (e.g., phenyl, chlorophenyl, methoxyphenyl, methylphenyl, cyanophenyl) or —O—$R^{A''}$ (in Which $R^{A''}$ represents a hydrocarbon group which may be the same as the group for $R^{A18}$ and $R^{A19}$).

In the formula (VII), $R^{A20}$, $R^{A21}$, $R^{A22}$ and $R^{A23}$ may be the same or different and each represents a hydrogen atom or a hydrocarbon group. Preferably, each represents a hydrogen atom or a hydrocarbon group which may be the same as the group preferred for $R^{A18}$ and $R^{A19}$ The resins containing at least one functional group represented by any of the formulae (I) to (VII) for use in the present invention can be prepared by protecting the thiol group(s) in a thiol group-containing polymer with a protective group by polymer reaction or by polymerizing a monomer having one or more protected thiol groups or copolymerizing the monomer with other copolymerizable monomer(s).

It is difficult to directly polymerize a thiol group-containing monomer, since the thiol group of the monomer interferes with radical polymerization. Accordingly, the thiol group may be introduced into a thiol group-free polymer by polymer reaction; or alternatively, the thiol group in the monomer to be polymerized is previously protected to a protected functional group, for example, in the form of a isothiuronium salt or Bunte salt, the thus protected monomer is polymerized and then the resulting polymer is subjected to a decomposition reaction to decompose the protected thio group into a free thiol group.

The method of producing the thiol group containing polymers for use in the present invention, in which a monomer containing one or more functional groups of any of the formulae (I) to (VII) is polymerized or copolymerized, is therefore preferred, because polymers having one or more functional groups of protected thiol groups may freely be prepared, no impurities are introduced into the polymers formed and monomers having free (or unprotected) thiol group(s) are hardly polymerized.

For conversion of one or at least two thiol groups into one or more protected functional groups, for example, the methods described in the literature in Iwakura and K. Kurita, *Hanno-sei Kobunshi* (*Reactive Polymers*), pages 230 to 237 (published by Kodan-sha, 1977); *Shin-jikken Kagaku Koza* (*New Lecture of Experimental Chemistry*), Vol. 14, Synthesis and Reaction of Organic Compounds (III), Chap. 8, pages 1700 to 1713 (edited by Nippon Kagaku-kai and published by Maruzen, 1978); J. F. W. McOmie, *Protective Groups in Organic Chemistry,* Chap. 7 (published by Plenum Press, 1973); or S. Patai, *The Chemistry of the Thiol Group,* Part 2, Vol. 12, Chap. 14 (published by John Wiley & Sons, 1974) may be employed.

Monomers having one or more protected thiol groups, for example, those having one or more functional groups of the formulae (I) to (VII), can be prepared by converting the thiol group(s) in compounds having a polymerizable double bond and having at least one thiol group into the functional group(s) of the formulae (I) to (VII), for example, in accordance with the methods described in :the literature above or by reacting a compound .containing one or more functional groups of the formulae (I) to (VII) and a compound having a polymerizable double bond.

Specific examples of repeating units having one or more functional groups of the formulae (I) to (VII) are the following compounds, which, however, are not to be construed whatsoever as limitative.

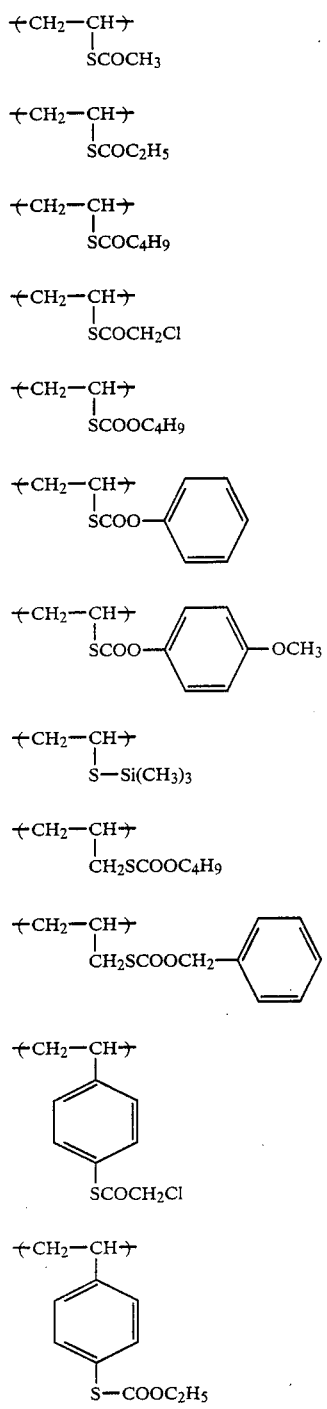

-continued
(13)
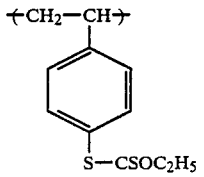
(14)
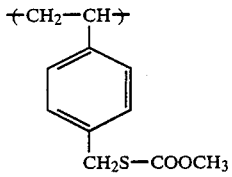
(15)
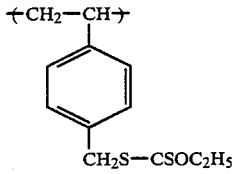
(16)
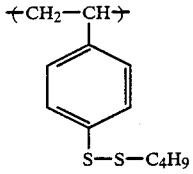
(17)
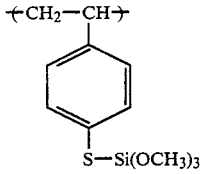
(18)
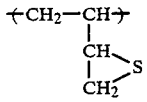
(19)
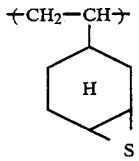
(20)
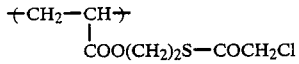
(21)
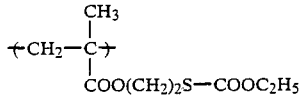
(22)
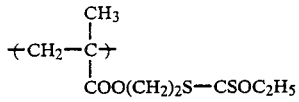
-continued
(23)
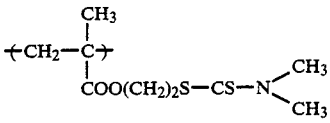
(24)
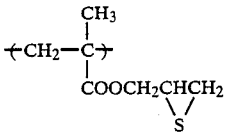
(25)
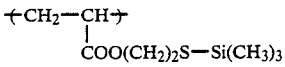
(26)
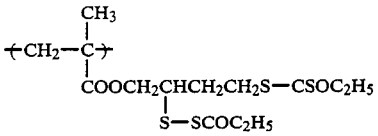
(27)
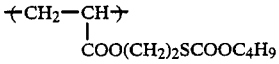
(28)
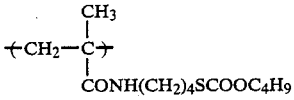
(29)
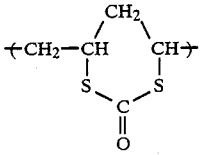
(30)
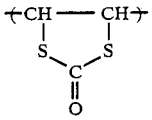
(31)
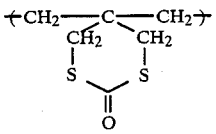
(32)
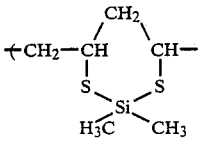
(33)
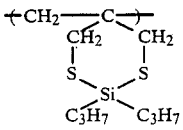
(34)
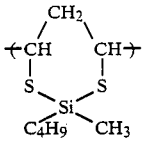

-continued
(35)
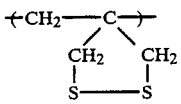
(36)
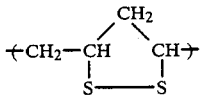
(37)
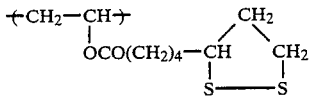
(38)
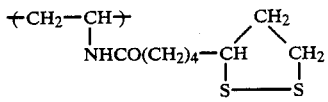
(39)
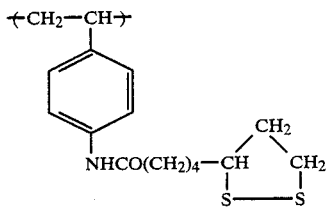
(40)
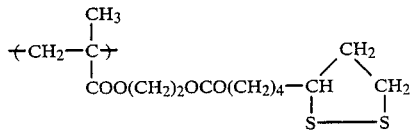
(41)
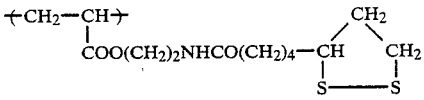
(42)
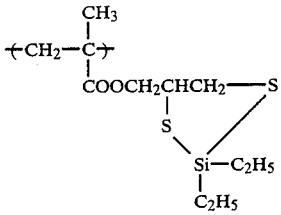
(43)
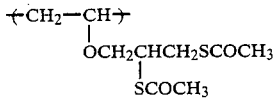
(44)
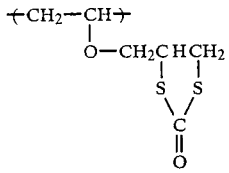
-continued
(45)
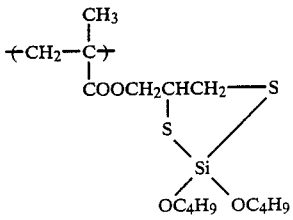
(46)
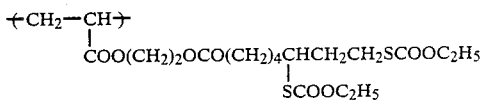
(47)
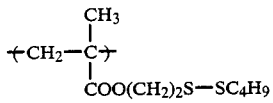
(48)
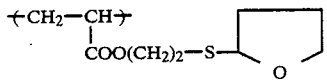
(49)
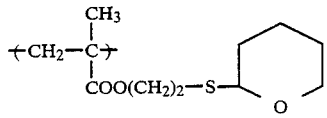
(50)
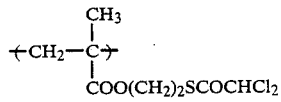
(51)
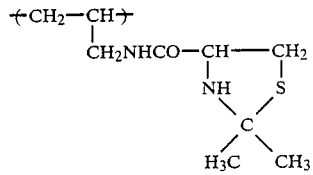
(52)
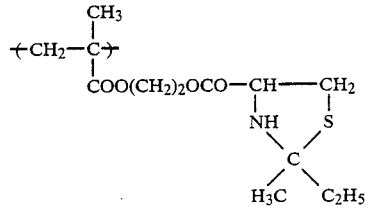
(53)
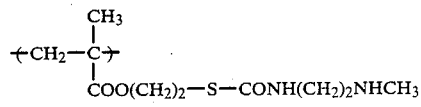
Resins containing functional group(s) capable of forming a phosphono group, such as those of the following formula (VIII) or (IX), by decomposition, which can be used in the present invention, are explained in detail hereunder.
(VIII)
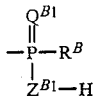

-continued

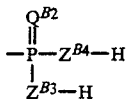

(IX)

In the formulae (VIII), $R^B$ represents a hydrocarbon group or $—Z^{B2}-R^{B'}$ (in which $R^{B'}$ represents a hydrocarbon group, and $Z^{B2}$ represents an oxygen atom or a sulfur atom). $Q^{B1}$ represents an oxygen atom or a sulfur atom. $Z^{B1}$ represents an oxygen atom or a sulfur atom. In the formula (IX), $Q^{B2}$, $Z^{B3}$ and $Z^{B4}$ independently represent an oxygen atom or a sulfur atom.

Preferably, $R^B$ represents an optionally substituted linear or branched alkyl group having from 1 to 12 carbon atoms (e.g., methyl, ethyl, propyl, butyl, pentyl, hexyl, octyl, decyl, 2-methoxyethyl, 3-methoxypropyl, 2-ethoxyethyl), an optionally substituted alicyclic group having from 5 to 8 carbon atoms (e.g., cyclopentyl, cyclohexyl), an optionally substituted aralkyl group having from 7 to 12 carbon atoms (e.g., benzyl, phenethyl, methylbenzyl, methoxybenzyl, chlorobenzyl), an optionally substituted aromatic group having from 6 to 12 carbon atoms (e.g., phenyl, chlorophenyl, tolyl, xylyl, methoxyphenyl, methoxycarbonylphenyl, dichlorophenyl) or $—Z^{B2}—R^{B'}$ (where $Z^{B2}$ represents an oxygen atom or a sulfur atom, and $R^{B'}$ represents a hydrocarbon group, examples of which include the hydrocarbon groups mentioned for $R^B$).

$Q^{B1}$, $Q^{B2}$, $Z^{B1}$, $Z^{B3}$ and $Z^{B4}$ independently represent an oxygen atom or a sulfur atom.

Examples of the functional groups capable of forming the phosphono group represented by the formula (VIII) or (IX) by decomposition are those represented by the following formulae (X) and/or (XI).

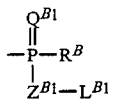

(X)

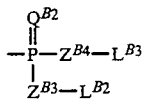

(XI)

In the formulae (X) and (XI), $Q^{B1}$, $Q^{B2}$, $Z^{B1}$, $Z^{B3}$ $Z^{B4}$ and $R^B$ have the same meanings as those defined for the formulae (VIII) and (IX).

$L^{B1}$, $L^{B2}$ and $L^{B3}$ independently represent

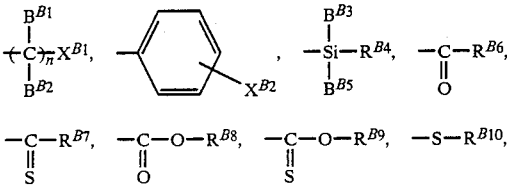

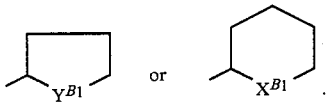

When $L^{B1}$ to $L^{Bis\ 3}$ each represents

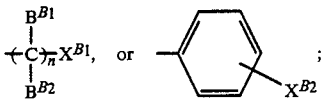

$R^{B1}$ and $R^{B2}$ may be the same or different and each represents a hydrogen atom, a halogen atom (e.g., chlorine, bromine, fluorine) or a methyl group. $X^{B1}$ and $X^{B2}$ each represents an electron-attracting substituent, preferably a halogen atom (e.g., chlorine, bromine, fluorine), —CN, $—CONH_2$, $—NO_2$ or $—SO_2R^{B''}$ (in which $R^{B''}$ represents a hydrocarbon group such as methyl, ethyl, propyl, butyl, hexyl, benzyl, phenyl, tolyl, xylyl or mesityl). n represents 1 or 2. When $X^{B1}$ is methyl group, $R^{B1}$ and $R^{B2}$ both are methyl groups and n is 1.

When $L^{B1}$ to $^{B2}$ each represents

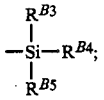

$R^{B3}$, $R^{B4}$ and $R^{B5}$ may be the same or different and each preferably represents a hydrogen atom, an optionally substituted linear or branched alkyl group having from 1 to 18 carbon atoms (e.g., methyl, ethyl, propyl, butyl, hexyl, octyl, decyl, dodecyl, octadecyl, chloroethyl, methoxyethyl, methoxypropyl), an optionally substituted alicyclic group having from 5 to 8 carbon atoms (e.g., cyclopentyl cyclohexyl), an optionally substituted aralkyl group having from 7 to 12 carbon atoms (e.g., benzyl, phenethyl, chlorobenzyl, methoxybenzyl), an optionally substituted aromatic group having from 6 to 12 carbon atoms (e.g., phenyl, naphthyl, chlorophenyl, tolyl, methoxyphenyl, methoxycarbonylphenyl, dichlorophenyl) or $—O—R^{B'''}$ (in which $R^{B'''}$ represents a hydrocarbon group, examples of which include the hydrocarbon groups described for $R^{B3}$, $R^{B4}$ and $R^{B5}$).

When $L^{B1}$ to $L^{B2}$ each represent

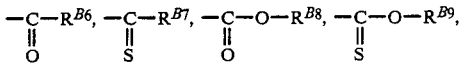

or $—S—R^{B10}$; $R^{B6}$, $R^{B7}$, $R^{B8}$, $R^{B9}$ and $R^{B10}$ independently represent a hydrocarbon group, preferably an optionally substituted linear or branched alkyl group having from 1 to 6 carbon atoms (e.g., methyl, trichloromethyl, trifluoromethyl, methoxymethyl, phenoxymethyl, 2,2,2-trifluoroethyl, ethyl, propyl, hexyl, t-butyl, hexafluoro-1-propyl), an optionally substituted aralkyl group having from 7 to 12 carbon atoms (e.g., benzyl, phenethyl, methylbenzyl, trimethylbenzyl, pentamethylbenzyl, methoxybenzyl or an optionally substituted aryl group having from 6 to 12 carbon atoms (e.g., phenyl, tolyl, xylyl, nitrophenyl, cyanophenyl, methanesulfonylphenyl, methoxyphenyl, butoxyphenyl, chlorophenyl, dichlorophenyl, trifluoromethylphenyl).

When $L^{B1}$ to $L^{B2}$ each represents

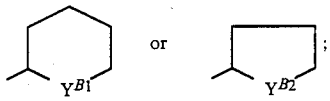

$Y^{B1}$ and $Y^{B2}$ each represents an oxygen atom or a sulfur atom.

The resins having at least one functional group for use in the present invention can be prepared by a method of protecting the hydrophilic group (phosphono group) of the aforesaid formula (VIII) or (IX) in a polymer by a protective group by polymer reaction, or by a method of polymerizing a monomer having a previously protected functional group (for example, the functional group of formula (X) or (XI)) or copolymerizing the monomer with a copolymerizable monomer.

In any of these methods, the same synthesizing reaction may be employed. Briefly, the resins for use in the present invention can be prepared by the method described in the literature as referred to in J. F. W. McOmie, *Protective Groups in Organic Chemistry,* Chap. 6 (published by Plenum Press, 1973), or in accordance with the same synthesizing reaction as the method of introducing a protective group into the hydroxyl group in a polymer described in literature of *Shin-jikken Kagaku Koza* (*New Lecture of Experimental Chemistry*), Vol. 14, Synthesis and Reaction of Organic Compounds (V), page 2497 (published by Maruzen, 1978) or also in accordance with the, same synthesizing reaction as the method of introducing a protective group into the thiol group in a polymer described in literature of S. Patai, *The Chemistry of the Thiol Group, Part* 2, Vol. 13, Chap. 14 (published by Wiley-Interscience, 1974) or T. W. Greene, *Protective Groups in Organic Synthesis,* Chap. 6 (published by Wiley-Interscience, 1981).

Examples of compounds suitable as repeating units of the polymer components containing the functional groups of the formulae (X) and/or (XI) as protective groups are shown below, which, however, are not intended to restrict the scope of the present invention.

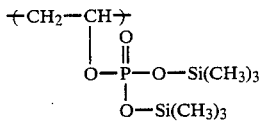
(54)

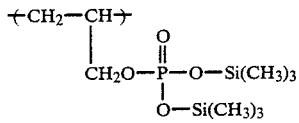
(55)

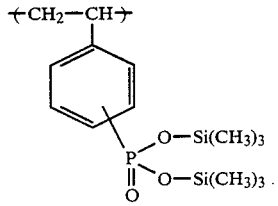
(56)

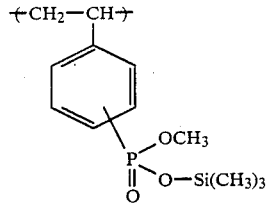
(57)

-continued

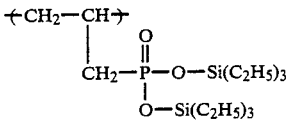
(58)

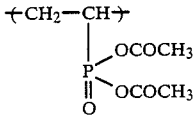
(59)

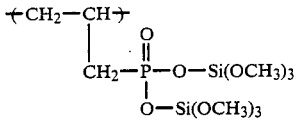
(60)

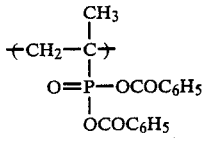
(61)

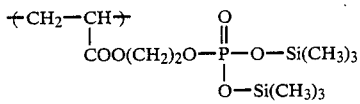
(62)

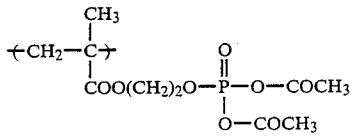
(63)

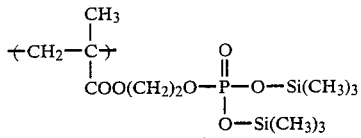
(64)

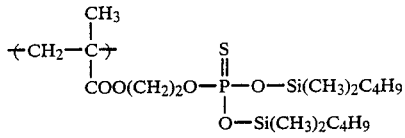
(65)

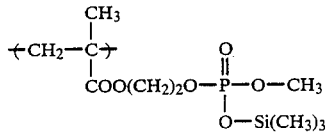
(66)

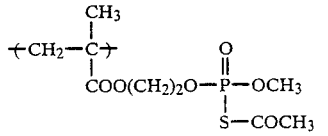
(67)

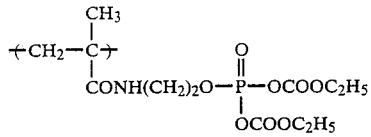
(68)

-continued (69)

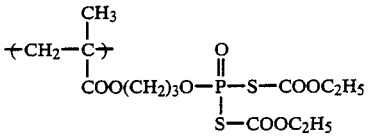

(70)

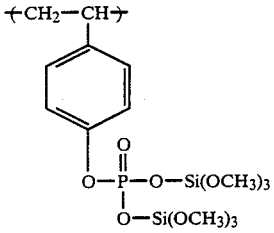

(71)

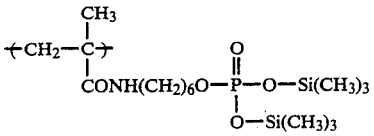

(72)

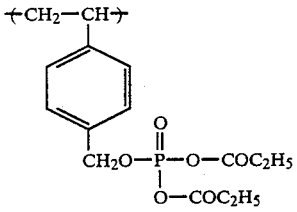

(73)

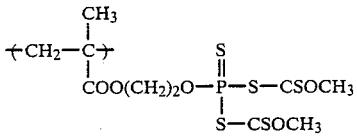

(74)

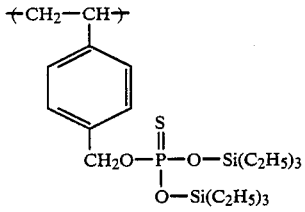

(75)

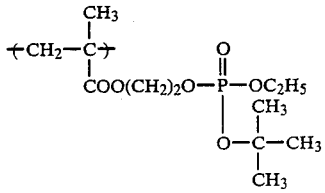

(76)

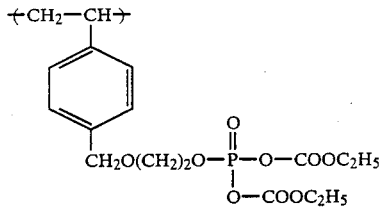

-continued (77)

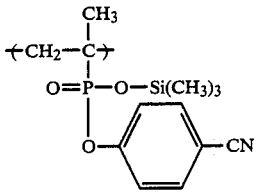

(78)

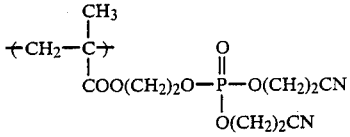

Functional groups capable of forming amino group(s), such as $—NH_2$ group and/or $—NHR^{C0}$ group, for example, are groups as represented by any of the following general formulae (XII) to (XIV).

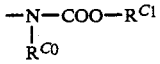

(XII)

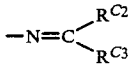

(XIII)

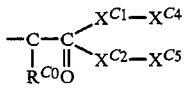

(XIV)

In the formulae (XII) and (XIV), $R^{C0}$ represents a hydrogen atom, an optionally substituted alkyl group having from 1 to 12 carbon atoms (e.g., methyl, ethyl, propyl, butyl, hexyl, octyl, decyl, dodecyl, 2-chloroethyl, 2-bromoethyl, 2-chloropropyl, 2-cyanoethyl, 2-methoxyethyl, 2-ethoxyethyl, 2-methoxycarbonylethyl, 3-methoxypropyl, 6-chlorohexyl), an alicyclic group having from 5 to 8 carbon atoms (e.g., cyclopentyl, cyclohexyl), an optionally substituted aralkyl group having from 7 to 12 carbon atoms (e.g., benzyl, phenethyl, 3-phenylpropyl, 1-phenylpropyl, chlorobenzyl, methoxybenzyl, bromobenzyl, methylbenzyl) or an optionally substituted aryl group having from 6 to 12 carbon atoms (e.g., phenyl, chlorophenyl, dichlorophenyl, tolyl, xylyl, mesityl, chloromethyl, chlorophenyl, methoxyphenyl, ethoxyphenyl, chloromethoxyphenyl).

When $R^{C0}$ represents a hydrocarbon group, such preferably has from 1 to 8 carbon atoms.

In the functional group of formula (XII), $R^{C1}$ represents an optionally substituted aliphatic group having from 2 to 12 carbon atoms, more specifically group of the following formula (XV)

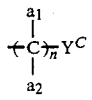

(XV)

where $a_1$ and $a_2$ each represents a hydrogen atom, a halogen atom (e.g., chlorine, fluorine) or an optionally substituted hydrocarbon group having from 1 to 12 carbon atoms (e.g., methyl, ethyl, propyl, butyl, hexyl, methoxyethyl, ethoxymethyl, 2-methoxyethyl, 2-chloroethyl, 3-bromopropyl, cyclohexyl, benzyl, chlorobenzyl, methoxybenzyl, methylbenzyl, phenethyl, 3-phenylpropyl, phenyl, tolyl, xylyl, mesityl, chlorophenyl, methoxyphenyl, dichlorophenyl, chloromethylphenyl, naphthyl); $Y^c$ represents a hydrogen atom, a halogen atom (e.g., fluorine, chlorine), a cyano group, an alkyl group having from 1 to 4 carbon atoms (e.g., methyl, ethyl, propyl, butyl), an optionally substituted aromatic group having 6 to 12 carbon atoms (e.g., phenyl, tolyl, cyanophenyl, 2,6-dimethylphenyl, 2,4,6-trimethylphenyl, pentamethylphenyl, 2,6-dimethoxyphenyl, 2,4,6-trimethoxyphenyl, 2-propylphenyl, 2-butylphenyl, 2-chloro-6-methylphenyl, furanyl) or $-SO_2-R^{C6}$ (in which $R^{C6}$ has the same meaning as the hydrocarbon group of $Y^c$); and n represents 1 or 2.

More preferably, when $Y^c$ represents a hydrogen atom or an alkyl group, $a_1$ and $a_2$ on the carbon atom adjacent the oxygen atom of the urethane bond are substituents other than a hydrogen atom.

When $Y^c$ is not a hydrogen atom or an alkyl group, $a_1$ and $a_2$ may be any of the above-mentioned groups.

Specifically, $R^{c1}$ of

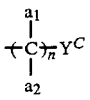

containing at least one or more electron-attracting groups or is a group in which the carbon adjacent the oxygen atom of the urethane bond forms a stereo-structurally high bulky group, as preferred examples.

Alternatively, $R^{c1}$ represents an alicyclic group, for example, a mono-cyclic hydrocarbon group (e.g., cyclopropyl, cyclobutyl, cyclopentyl, cyclohexyl, 1-methyl-cyclohexyl, 1-methylcyclobutyl) or a cross-linked cyclic hydrocarbon group (e.g., bicyclooctane, bicyclooctene, bicyclononane, tricycloheptane).

In the formula (XIII), $R^{c2}$ and $R^{c3}$ may be the same or different and each represents a hydrocarbon group having from 1 to 12 carbon atoms, for example, an aliphatic group or an aromatic group such as the group of $Y^c$.

In the formula (XIV), $X^{c1}$ and $X^{c2}$ may be the same or different and each represents an oxygen atom or a sulfur atom. $X^{c4}$ and $X^{c5}$ may be the same or different and each represents a hydrocarbon group having from 1 to 8 carbon atoms, for example, an aliphatic group or an aromatic group such as a group of $Y^c$ in the formula (XII).

Specific examples of the functional groups of th formulae (XII) to (XIV) are mentioned below, which, however, are not intended to restrict the scope of the present invention.

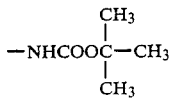
(79)

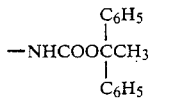
(80)

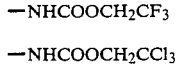
(81)

(82)

-continued

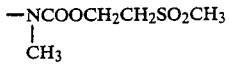
(83)

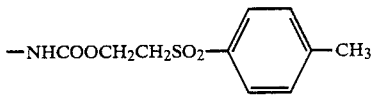
(84)

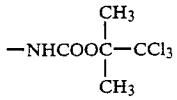
(85)

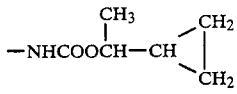
(86)

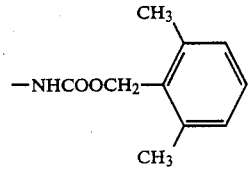
(87)

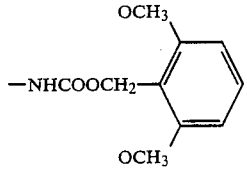
(88)

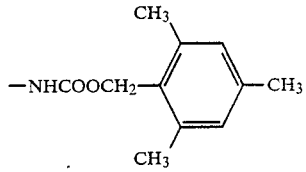
(89)

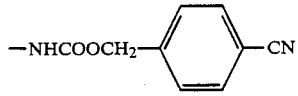
(90)

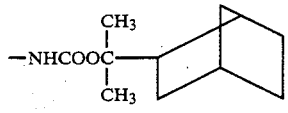
(91)

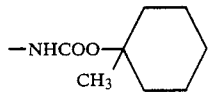
(92)

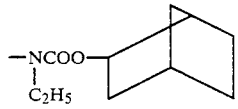
(93)

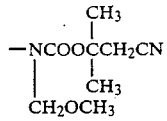
(94)

-continued (95)

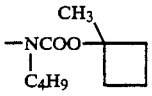

(96)

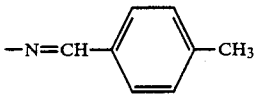

(97)

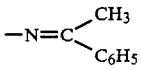

(98)

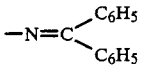

(99)

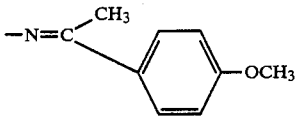

(100)

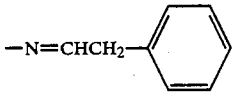

(101)

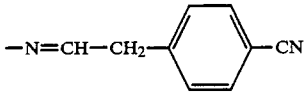

(102)

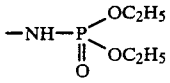

(103)

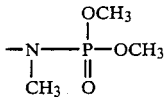

(104)

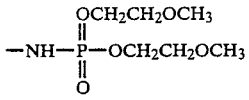

(105)

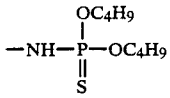

Resins having at least one functional group capable of forming an amino group (for example $—NH_2$ and/or $—NHR^{c0}$) by decomposition, for example, at least one functional group selected from the groups of the aforesaid formulae (XII) to (XIV), for use in the present invention can be prepared, for example, in accordance with the methods described in the literature as referred to in *Shin-jikken Kaqaku Koza (New Lecture of Experimental Chemistry)*, Vol. 4, page 2555 published by Maruzen), J. F. W. McOmie, *Protective Groups in Organic Chemistry,* Chap. 2 (published by Plenum Press, 1973) or *Protective Groups in Organic Synthesis,* Chap. 7 (published by John Wiley & Sons, 1981).

The method of preparing the resins from monomers previously containing the functional group of any one of the formulae (XII) to (XIV) by polymerization reaction is preferred, because polymers having the functional group of any one of the formulae (XII) to (XIV) may freely be prepared or no impurities are introduced into the polymers formed. Specifically, the primary or secondary amino group in a primary or secondary amine containing a polymerizable double bond is converted into a functional group of any one of the formulae (XII) to (XV) in accordance with the method described in the above literature, and then the resulting amine is polymerized. Examples of the functional group capable of forming at least one sulfo group ($—SO_3H$) by decomposition includes functional groups of the following formulae (XVI) or (XVII).

$$—SO_2—O—R^{D1} \quad \text{(XVI)}$$

$$—SO_2—S—R^{D2} \quad \text{(XVII)}$$

In the formula (XVI), $R^{D1}$ represents

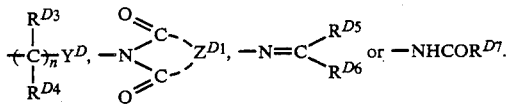

In the formula (XVII), $R^{D2}$ represents an optionally substituted aliphatic group having from 1 to 18 carbon atoms or an optionally substituted aryl group having from 6 to 22 carbon atoms.

The functional group as represented by the formula (XVI) or (XVII) forms a sulfo group by decomposition, and this is explained in detail hereunder.

When $R^{D1}$ represents

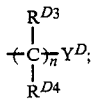

$R^{D3}$ and $R^{D4}$ may be the same or different and each represents a hydrogen atom, a halogen atom (e.g., fluorine, chlorine, bromine), an alkyl group having from 1 to 6 carbon atoms (e.g., methyl, ethyl, propyl, butyl, pentyl, hexyl) or an aryl group having from 6 to 12 carbon atoms (e.g., phenyl). Y represents an optionally substituted alkyl group having from 1 to 18 carbon atoms (e.g., methyl, ethyl, propyl, butyl, pentyl, hexyl, octyl, decyl, dodecyl, hexadecyl, trifluoromethyl, methanesulfonylmethyl, cyanomethyl, 2-methoxyethyl, ethoxymethyl, chloromethyl, dichloromethyl, trichloromethyl, 2-methoxycarbonylethyl, 2-propoxycarbonylethyl, methylthiomethyl, ethylthiomethyl), an optionally substituted alkenyl group having from 2 to 18 carbon atoms (e.g., vinyl, allyl), an optionally substituted aryl group having from 6 to 12 carbon atoms (e.g., phenyl, naphthyl, nitrophenyl, dinitrophenyl, cyanophenyl, trifluoromethylphenyl, methoxycarbonylphenyl, butoxycarbonylphenyl, methanesulfonylphenyl, benzenesulfonylphenyl, tolyl, xylyl, acetoxyphenyl, nitronaphthyl) or

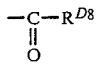

(in which $R^{D8}$ represents an aliphatic group or an aromatic group, examples of which include the groups described for group $Y^D$). n represents 0, 1 or 2.

More preferably, the substituent

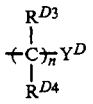

is a functional group containing at least one electron-attracting group. Specifically, when n is 0 and $Y^D$ is a hydrocarbon group containing no electron-attracting group, the substituent

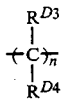

contains at least one or more halogen atoms. Alternatively, n is 0, 1 or 2, and $Y^D$ contains at least one electron attracting group. Further, n is 1 or 2, and the group

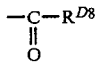

corresponds to

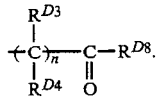

The electron-attracting group means a substituent having a positive Hammett's substituent constant, for example, including a halogen atom —COO—,

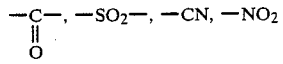

and the like.

A still another preferred substituent of $—SO_2—O—R^{D1}$ is one where the carbon atom adjacent the oxygen atom in the formula is substituted by at least two hydrocarbon groups, or when n is 0 or 1 and $Y^D$ is an aryl group, the 2-position and 6-position of the aryl group have substituents.

When $R^{D1}$ represents

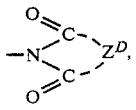

$Z^D$ represents an organic residue forming a cyclic imido group. Preferably, this represents an organic group of the following formulae (XVIII) or (XIX).

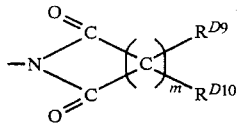

(XVIII)

-continued

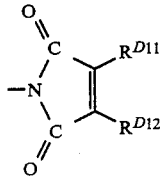

(XIX)

In the formula (XVIII), $R^{D9}$ and $R^{D10}$ may be the same or different and each represents a hydrogen atom, a halogen atom (e.g., chlorine, bromine), an optionally substituted alkyl group having from 1 to 18 carbon atoms (e.g., methyl, ethyl, propyl, butyl, hexyl, octyl, decyl, dodecyl, hexadecyl, octadecyl, 2-chloroethyl, 2-methoxyethyl, 2-cyanoethyl, 3-chloropropyl, 2-(methanesulfonyl)ethyl, 2-(ethoxyoxy)ethyl), an optionally substituted aralkyl group having from 7 to 12 carbon atoms (e.g., benzyl, phenethyl, 3-phenylpropyl, methylbenzyl, dimethylbenzyl, methoxybenzyl, chlorobenzyl, bromobenzyl) or an optionally substituted alkenyl group having from 3 to 18 carbon atoms (e.g., allyl, 3-methyl-2-propenyl).

When $R^{D1}$ represents

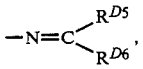

$R^{D5}$ and $R^{D6}$ each represents a hydrogen atom, an aliphatic group (examples of which include those for $R^{D3}$ and $R^{D4}$) or an aryl group (examples of which include those for $R^{D3}$ and $R^{D4}$), proved that both $R^{D5}$ and $R^{D6}$ must not be hydrogens at the same time.

When $R^{D1}$ represents $—NHCOR^{D7}$, $R^{D7}$ represents an aliphatic group or an aryl group, examples of which include those for $R^{D3}$ and $R^{D4}$.

In the formula (XVII), $R^{D2}$ represents an optionally substituted aliphatic group having from 1 to 18 carbon atoms or an optionally substituted aryl group having from 6 to 22 carbon atoms.

More specifically, $R^{D2}$ in the formula (XVII) represents an aliphatic group or an aryl group, examples of which include those for $Y^D$ in the formula (XVI).

The resins containing at least one functional group selected from the groups consisting of $(—SO_2—O—R^{D1})$ and $(—SO_2—O—R^{D2})$, for use in the present invention, can be prepared by a method of converting the sulfo group in a polymer into a functional group of the formula (XVI) or (XVII) by polymer reaction, or by a method of polymerizing one or more monomers containing one or more functional groups of the formula (XVI) or (XVII) or copolymerizing the monomer and a copolymerizable monomer.

The method of converting the sulfo group into the functional group can be conducted in the same manner for preparing the functional group-containing monomers, also in a polymer reaction.

The methods for preparing these resins are described in detail, for example, in *Shin-jikken Kagaku Koza* (New Lecture of Experimental Chemistry), Vol. 14 (III), page 1793 (1978) (edited by Nippon Kagakukai, published by Maruzen); J.P. Weidner and S.S. Block, *Synthesis*, 1970, 583; C. O. Meese, *Synthesis*, 1984, 1041; and G. Berner, R. Kirchmayr, G. Rist and W. Rutsh, *Journal of Radiation Curing*, 1986 (10), 10.

Specific examples of the functional groups of the formulae (XVI) $—SO_2—O—R^{D1}$ and (XVII) $—SO_2—S—R^{D2}$ are the following groups, which, however, are not intended to restrict the scope of the present invention.
(106)
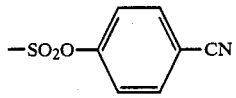
(107)
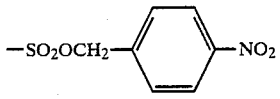
$—SO_2OCH_2CF_3$ (108)
(109)
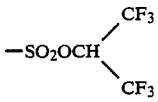
$—SO_2OCH_2(CHF)_2CH_2F$ (110)
$—SO_2OCH_2CCl_3$ (111)
(112)
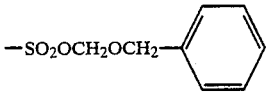
$—SO_2O(CH_2)_2SO_2C_4H_9$ (113)
(114)
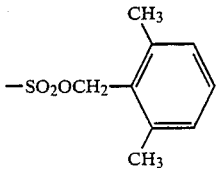
(115)
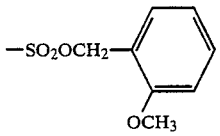
(116)
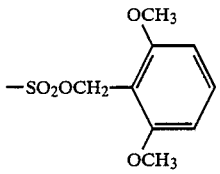
(117)
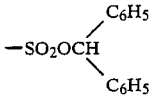
(118)
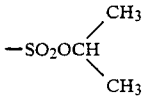
(119)
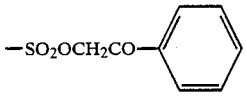
-continued
(120)
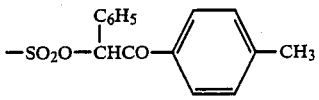
(121)
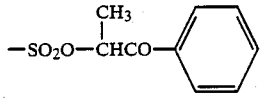
(122)
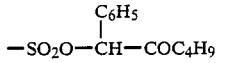
$—SO_2O(CH_2)_2SO_2C_2H_5$ (123)
$—SO_2SC_4H_9$ (124)
$—SO_2SC_6H_{13}$ (125)
$—SO_2S(CH_2)_2OC_2H_5$ (126)
(127)
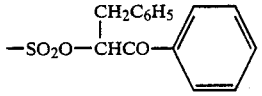
$—SO_2OCH_2CHFCH_2F$ (128)
(129)
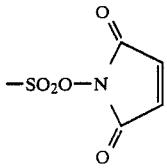
(130)
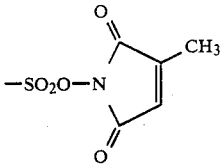
(131)
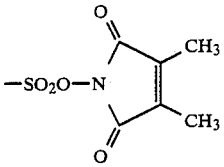
(132)
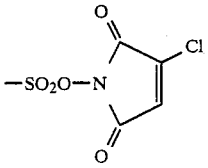
(133)
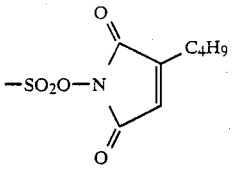

-continued (134)

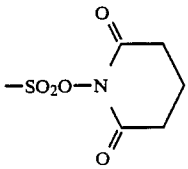

(135)

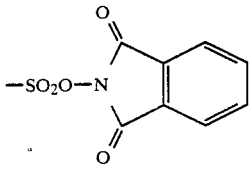

(136)

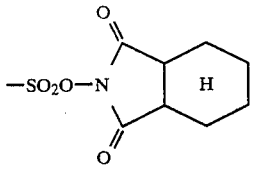

(137)

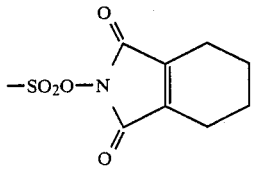

(138)

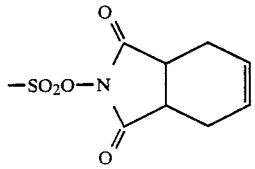

Examples of the copolymer components containing functional group(s) of any of the formulae (I) to (VII), (X) to (XIV) and (XVI) and (XVII) above, which are used in the above methods for preparation of the resins for use in the present invention by a polymer reaction are the copolymer components represented by the following formula (A), which, however, are not intended to restrict the scope of the present invention.

(A)

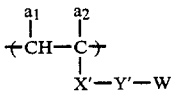

In the formula (A), X' represents

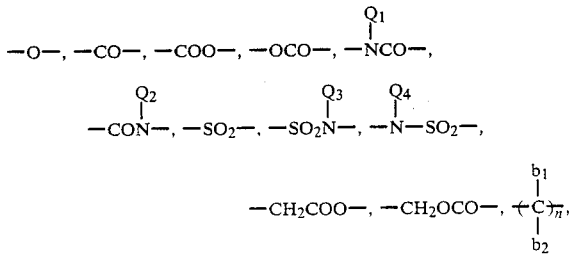

an aromatic group (e.g., an optionally substituted phenyl group such as phenyl, tolyl, xylyl, chlorophenyl or cyanophenyl, or an optionally substituted naphthyl group) or a 5-membered or 6-membered heterocyclic group containing at least one hetero atom selected from N, O and S. $Q_1$, $Q_2$, $Q_3$ and $Q_4$ each represents a hydrogen atom, a hydrocarbon group, preferably having up to 18 carbon atoms and including a chain or cyclic alkyl group, an aralkyl group, an alkenyl group and an aryl group, or a group of —(Y'—W) in the formula (VI); $b_1$ and $b_2$ may be the same or different and each represents a hydrogen atom, a hydrocarbon group, preferably having up to 7 carbon atoms and including a chain or cyclic alkyl group, an alkenyl group, an aralkyl group or an aryl group, or a group of —(Y'—W) in the formula (VI); and n represents an integer of from 0 to 18.

Y' represents an optionally hetero atom-interrupted carbon-carbon linkage which links the bonding group X' and the bonding group (W), the hetero atom being an oxygen atom, a sulfur atom or a nitrogen atom.

For example, Y' represents a linkage composed of one or more linking units of

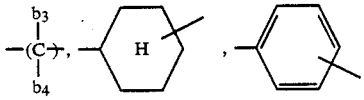

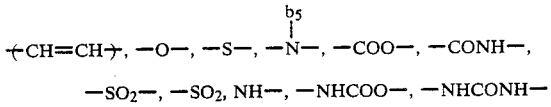

and the like. $b_3$, $b_4$ and $b_5$ have the same meanings as those for $b_1$ and $b_2$.

W represents a functional group of any of the formulae (I) to (VII), (X) to (XIV) and (XVI) and (XXVII).

$a_1$ and $a_2$ may be the same or different and each represents a hydrogen atom, a halogen atom (e.g., chlorine, bromine), a cyano group, an alkyloxycarbonyl group (e.g, methoxycarbonyl, ethoxycarbonyl, propoxycarbonyl, butoxycarbonyl, hexyloxycarbonyl) or a hydrocarbon group (for example, an optionally substituted alkyl group having from 1 to 12 carbon atoms such as methyl, ethyl, propyl, butyl, methoxycarbonylmethyl, ethoxycarbonylmethyl, butoxycarbonylmethyl; or an aralkyl group such as benzyl, phenethyl; or an aryl group such as phenyl, tolyl, xylyl, chlorophenyl).

The bonding residue of (—X'—Y') in the formula (A) may directly link the moiety

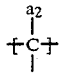

and the moiety (—W).

The copolymer components may be copolymerized with any other copolymerizable monomers, which include, for example, vinyl or allyl esters of aliphatic carboxylic acids such as vinyl acetate, vinyl propionate, vinyl butyrate, allyl acetate or allyl propionate, unsaturated carboxylic acids such as acrylic acid, methacrylic acid, crotonic acid, itaconic acid, maleic acid, furmaric acid, or esters or amides of these unsaturated carboxylic acids, styrene derivatives such as styrene, vinyltoluene, α-methylstyrene, and vinyl group-substituted heterocyclic compounds such as α-olefins, acrylonitrile, methacrylonitrile, N-vinyl pyrrolidone.

When the resin of the present invention is a copolymer, a preferred proportion of the repeating unit containing a hydrophilic group-producing functional group ranges from 1 to 95 wt %, particularly from 5 to 60 wt %, with respect to all units in the copolymer. A suitable molecular weight of the copolymer resin ranges from about $1\times10^3$ to about $1\times10^6$, preferably from $5\times10^3$ to $5\times10^5$, more preferably from $3\times10^4$ to $4\times10^5$.

The resin of the present invention is further characterized by cross linkages formed at least in part among resin molecules when the resin constitutes an electrophotographic lithographic printing plate precursor.

In order to obtain partial cross-linkage as described above, a previously cross-linked polymer may be used at the stage of coating a photoreceptive layer-forming composition during the plate-making process, or a heat and/or light curable resin containing cross-linkable functional groups may be used and cross-linked in the course of producing a lithographic printing plate precursor (e.g., in the drying step), or these resins may be used together.

The amount of a component containing cross-linkable functional groups is preferably from about 0.1 to about 10% by weight, when the cross-linkable groups are copolymer components containing polymerizable double bonds, or from about 1 to about 80% by weight, when the cross-linkable groups are copolymer components containing cross-linkable groups other than the polymerizable double bonds.

In using a resin previously cross-linked in part (i.e., a resin having a cross-linking structure among polymer molecules) as resin binder, the resin preferably should become slightly soluble or insoluble in an acidic or alkaline aqueous solution when the foregoing hydrophilic group-producing functional groups contained in the resin are decomposed to produce hydrophilic groups.

More specifically, preferred resins have solubilities of 50 g or less, particularly 30 g or less, in 100 g of distilled water at 25° C. The solubility of the resin as defined herein means the solubility after the resin has been subjected to the oil-desensitization treatment.

In introducing a cross-linking structure into polymer molecules of a resin, conventional methods can be employed.

For example, a method of polymerizing monomer(s) in the presence of a polyfunctional monomer can be employed, and a method of introducing functional groups capable of promoting a cross-linking reaction into polymers and cross-linking these polymers by a polymer reaction can be employed.

For the introduction of a cross-linking structure in the resin of this invention, functional groups capable of undergoing a self cross-linking reaction, represented by —$CONHCH_2OR'$ (wherein R' is a hydrogen atom or an alkyl group), or cross-linking reactions through polymerization are effective from the standpoints of the absence of adverse effects upon electrophotographic characteristics and simplicity of preparation (e.g., the reaction is fast, the reaction proceeds stoichiometrically, and contamination with impurities is minimal because no auxiliary agent is used for accelerating the reaction).

The resin of the present invention can be prepared by polymerizing a monomer containing polymerization reactive groups having preferably two or more of polymerizing functional groups, together with a monomer containing functional group(s) capable of producing hydrophilic group(s) through decomposition; or by copolymerizing a monomer containing two or more polymerizing functional groups and a monomer containing hydrophilic group(s), and then protecting the hydrophilic group(s) in a manner as described above.

Specific examples of polymerizing functional groups include $CH_2{=}CH-$, $CH_2{=}CH-CH_2-$, $CH_2{=}CH-COO-$, $CH_2{=}C(CH_3)-COO-$, $CH_3CH{=}CH-COO-$, $CH_2{=}CH-CONH-$, $CH_2{=}C(CH_3)-CONH-$, $CH_3CH{=}CH-CONH-$, $CH_2{=}CH-OCO-$, $CH_2{=}C(CH_3)-OCO-$, $CH_2{=}CH-CH_2-OCO-$, $CH_2{=}CH-NHCO-$, $CH_2{=}CH-CH_2-NHCO-$, $CH_2{=}CH-SO_2-$, $CH_2{=}CH-CO-$, $CH_2{=}CH-O-$, $CH_2{=}CH-S-$, etc.

The two or more polymerizing functional groups contained in the above-described monomers may be either the same or different selected from the above-cited groups to form polymers insoluble in nonaqueous solvents through polymerization.

Specific examples of monomers containing two or more of polymerizing functional groups of the same kind include styrene derivatives such as divinylbenzene, trivinylbenzene, etc.; methacrylic acrylic or crotonic acid esters, vinyl ethers or ally ethers of polyhydric alcohols (e.g., ethylene glycol, diethylene glycol, triethylene glycol, polyethylene glycol #200, #400, #600, 1,3-butylene glycol, neopentyl glycol, dipropylene glycol, polypropylene glycol, trimethylolpropane, trimethylolethane, pentaerythritol) or polyhydroxyphenols (e.g., hydroquinone, resorcine, catechol and their derivatives); vinyl esters, ally esters, vinyl amides or allyl amides of dibasic acids (e.g., malonic acid, succinic acid, glutaric acid, adipic acid, pimelic acid, maleic acid, phthalic acid, itaconic acid); condensates of polyamines (e.g., ethylenediamine, 1,3-propylenediamine, 1,4-butylenediamine) and carboxylic acids containing a vinyl group (e.g., methacrylic acid, acrylic acid, crotonic acid, allylacetic acid); etc.

Specific examples of monomers containing two or more different kinds of polymerizing functional groups include vinyl group-containing ester or amide derivatives of vinyl group-containing carboxylic acids (e.g., methacrylic acid, acrylic acid, methacryloylacetic acid, acryloylacetic acid, methacryloylpropionic acid, acryloylpropionic acid, itaconyloylacetaic acid, itaconyloypropionic acid, reaction products of carboxylic acid anhydrides and alcohols or amines (such as allyloxycarbonylpropionic acid, allyoxycarbonylacetic acid, 2-allyloxycarbonylbenzoic acid, allylaminocarbonylpropionic acid)), with specific examples including vinylmethacrylate, vinylacrylate, vinylitaconate, allylmethacrylate, allylacrylate, allylitaconate, vinylmethacryloylacetate, vinylmethacryloylpropionate, allylmethacryloylpropionate, vinyloxycarbonylmethylmethacrylate, vinyloxycarbonylmethyloxycarbonylethylene acrylate, N-allylacrylamide, N-allylitaconic acid amide, methacryloylpropionic acid allyl amide, and so on; and condensates of aminoalcohols (e.g., aminoethanol, 1-aminopropanol, 1-aminobutanol, 1-aminohexanol, 2-aminobutanol) and vinyl-containing carboxylic acids.

The resins of the present invention are formed through polymerization using the above-described monomers containing two or more of polymerizing functional groups in a proportion of about 0.1 to about 10% by weight, preferably 0.5 to 5% by weight, based on the total monomers.

On the other hand, resins containing crosslinking functional groups capable of undergoing a curing reaction by heat and/or light together with the foregoing hydrophilic group-producing functional groups can be used as resin binder in the present invention, and a cross-linking structure may be formed therein at the subsequent stage of producing a plate precursor.

The above-described cross-linking functional group may be any of those capable of forming a chemical bond by undergoing a chemical reaction between molecules. More specifically, a usable mode of the chemical reaction involves causing the intermolecular bonding through a condensation reaction, addition reaction or so on, or the cross-linking through polymerization by application of heat and/or light. Specific examples of such functional groups include those containing at least one combination of a dissociable hydrogen-containing functional group (e.g.,

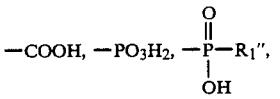

wherein $R_1''$ represents the same hydrocarbon residue as described in regard to $R_1$ to $R_3$ in the foregoing formula (I), or $—OR_1'''$ (wherein $R_1'''$ has the same meaning as $R_1''$), —OH, —SH, $—NHR_2''$ (wherein $R_2''$ represents a hydrogen atom, or an alkyl group containing 1 to 4 carbon atoms, e.g., methyl, ethyl, propyl, butyl, etc.) and a functional group selected from among

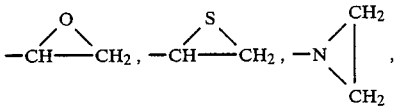

—NCO, —NCS and cyclic dicarboxylic acid anhydrides; $—CONHCH_2OR_3''$ (wherein $R_3''$ represents a hydrogen atom or an alkyl group containing 1 to 6 carbon atoms, e.g., methyl, ethyl, propyl, butyl, hexyl, etc.); and polymerizing double bond-containing groups.

Specific examples of polymerizing double bond-containing groups include those cited as specific examples of the foregoing polymerizing functional groups.

In addition, other functional groups and compounds can be used as cited in Goh Endo, *Netsukokasei Kobunshi no Seimitsuka,* C.M.C. K.K. (1986), Yuji Harasaki, *Saishin Binder Gijutsu Binran,* chap. II-1, Sogo Gijutsu Center (1985), Takayuki Otsu, *Acryl Jushi no Gosei Sekkei to Shin-Yoto Kaihatsu,* Chubu Keiei Kaihatsu Center Shuppanbu (1985), Eizo Ohmori, *Kinosei Akuriru-kei Jushi,* Techno System (1985), Hideo Inui & Gentaro Nagamatsu, Kenkosei Kobunshi, Kodansha (1977), Takahiro Tsunoda, *Shin-Kankosei Jushi,* Insatsu Gakkai Shuppanbu (1981), G. E. Green & B. P. Star, *J. Macro. Sci. Revs. Macro. Chem.,* C21(2), pp. 187–273 (1981–82), C. G. Roffey, *Photopolymerization of Surface Coatings,* A. Wiley Interscience Pub. (1982), and so on.

These cross-linking functional groups and hydrophilic group-producing functional groups may be contained together in the same copolymer constituent, or separately in different copolymer constituents.

Monomers which correspond to copolymer constituents containing cross-linking functional groups as described above may be e.g., any of the vinyl compounds containing functional groups which are copolymerizable with the groups of the foregoing general formula (II).

Such vinyl compounds are described, e.g., in KobunshiGakkai (High Molecular Society) (editor), *Kobunshi (High Molecular) Data Handbook (Kiso-hen (Basic Volume)),* Baihukan (1986). Specific examples of these vinyl compounds include acrylic acid, α- and/or β-substituted acrylic acids (e.g., α-acetoxyacrylic acid, α-acetoxymethylacrylic acid, α-(2-aminomethylacrylic acid, α-chloroacrylic acid, α-bromoacrylic acid, α-fluoroacrylic acid, α-tributylsilylacrylic acid, α-cyanoacrylic acid, β-chloroacrylic acid, β-bromoacrylic acid, α-chloro-β-methoxyacrylic acid, α,β-dichloroacrylic acid), methacrylic acid, itaconic acid, itaconic acid half esters, itaconic acid half amides, crotonic acid, 2-alkenylcarboxylic acids (e.g., 2-pentenic acid, 2-methyl-2-hexenic acid, 2-octenic acid), maleic acid, maleic acid half esters, maleic acid half amide, vinylbenzenecarboxylic acid, vinylsulfonic acid, vinylphosphonic acid, vinyl or allyl half ester derivatives of dicarboxylic acids, and ester or amide derivatives of these carboxylic or sulfonic acids containing the foregoing cross-linking functional groups in their substituents.

A preferred fraction of "the cross-linking functional group-containing copolymer constituent" in the resin of this invention ranges preferably from 1 to 80 wt %, and particularly from 5 to 50 wt %.

To these resins, a reaction accelerator may be added, if desired, for accelerating the cross-linking reaction. Examples of accelerators for the crosslinking reaction include acetic acid, propionic acid, butyric acid, benzenesulfonic acid, p-toluenesulfonic acid, peroxides, azobis compounds, cross-linking agents, sensitizers, photopolymerizing monomers, etc. For example, the compounds described in Shinzo Yamashita & Tosuke Kaneko. *Kakyozai (Cross-Linking Agents) Handbook,* Taiseisha (1981) can be employed as cross-linking agents. More specifically, cross-linking agents such as organic silanes, polyurethanes, polyisocyanates and so on, and curing agents such as epoxy resins, melamine resin and so on can be employed.

In the case of light cross-linkable functional groups, compounds cited as examples in the foregoing publications concerning light-sensitive resins can be used.

When the resins containing cross-linking functional groups are used, the cross-linking in at least part of polymers can be carried out in the process of forming a photoconductive layer, or upon heating and/or optical exposure prior to etching. Usually, a heat curing processing is preferred, and effected by strictly controlling the drying condition for production of conventional photoreceptors. For instance, the heat curing may be carried out at 60° to 120° C. for 5 to 120 minutes. When the curing processing is carried out in the presence of the above-described reaction accelerators, more gentle conditions can be employed.

Also, conventional resins can be used together with the resins of the present invention. Examples of those conventional resins include silicone resins, alkyd resins, vinyl acetate resins, polyester resins, styrenebutadiene resins, acryl resins, etc., and more specifically, known materials as cited e.g., in Ryuji Kurita & Jiro Ishiwatari, *Kobunshi,* Vol. 17, p. 278 (1968), Harumi Miyamoto & Hidehiko Takei, *Imaging,* No. 8, p. 9 (1973).

The resins of the present invention and conventional resins can be blended in an arbitrary ratio, provided that the content of hydrophilic group-producing functional group containing component in the total amount of the resins ranges from 0.5 to 95 wt %, particularly from 1 to 85 wt %, and more preferably from 30 to 85 wt %.

Since hydrophilic groups are converted to protected functional groups in the resins of the present invention, interaction with zinc oxide particles is minimized. In addition, the hydrophilic groups produced by an oil-desensitizing treatment further enhance the affinity of the nonimage area for water.

Moreover, in the plate precursor, though they become a soluble in water by release of hydrophilic groups in the oil-desensitizing treatment, the resins of the present invention prevent elution in the nonimage area due to the presence of a cross-linking structure in at least part of the polymer, while sufficient affinity for water is retained.

Accordingly, the affinity of the nonimage area for water is further enhanced by the hydrophilic groups produced in the resin, and the durability of the plate is also improved.

The effect of enhancing the affinity for water can be maintained as usual even when the proportion of hydrophilic group-producing functional group-containing resins to whole binder resins is reduced. A large number of clear prints free from background stains can be obtained even when a large-sized printing machine is used, or printing conditions including fluctuation of printing pressure are severe.

In the lithographic printing plate precursor of this invention, all the above-described resin binders are used in an amount of from 10 to 60 parts by weight, preferably 15 to 40 parts by weight, per 100 parts by weight of photoconductive zinc oxide.

In this invention, various kinds of dyes can be used together with the photoconductive zinc oxide as spectral sensitizers, if desired. Specific examples of such spectral sensitizers are carbonium type dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, styryl dyes) and metal free- or metallo-phthalo cyanine dyes, as described, for example, in Harumi Miyamoto & Hidehiko Takei, *Imaging,* No. 8, p. 12 (1973), C. J. Young, et al, *RCA Review,* Vol. 15, p. 469 (1954), Kohei Kiyota, *Denkitsushin Gakkai Ronbun Shi* (*Journal of Telecommunication Society*), J 63-C, No. 2, p. 97 (1980), Yuji Harasaki, *Kogyo Kagaku Zasshi* (*Journal of Industrial Chemistry*), Vol. 66, p. 78 and p. 188 (1963), Tadaaki Tani, *Nihon Shashin Gakkai Shi* (*Journal of The Society of Photographic Science and Technology of Japan,* Vol. 35, p. 208 (1972).

More specifically, dyes of carbonium type, triphenylmethane type, xanthene type and phthalein type, which are also used as spectral sensitizers are disclosed in JP-B-51-452, JP A-50-90334, JP-A-50-114227, JP-A-53-39130, JP-A-53-82353, U.S. Pat. No. 3,052,540, U.S. Pat. No. 4,054,450, JP-A-57-16456, and so on.

Polymethine dyes including oxonol dyes, merocyanine dyes, cyanine dyes, rhodacyanine dyes and the like, for use in the present invention, are described in F. M. Harmmer, *The Cyanine Dyes and Related Compound.* More specifically, such dyes include those disclosed in U.S. Pat. Nos. 3,047,384, 3,110,591, 3,121,008, 3,125,447, 3,128,179, 3,132,942 and 3,622,317, British Patents No. 1,226,892, 1,309,274 and 1,405,898, JP-B-48-7814, JP-B-55-18892, etc.

Moreover, specific examples of polymethine dyes spectrally sensitizing the near infrared to infrared regions of wavelengths longer than 700 nm are disclosed in JP-A-47-840, JP-A-47-44180, JP-B-51-41061, JP-A-49-5034, JP-A-49-45122, JP-A-57-46245, JP-B-56-35141, JP-A-57-157254, JP-A-61-26044, JP-A-61-27551, U.S. Pat. Nos. 3,619,154 and 4,175,956, *Research Disclosure,* No. 216, pp. 117–118 (1982). The photoreceptor of this invention is superior in the respect that the combined use of various sensitizing dyes causes little fluctuation in electrophotographic properties (initial voltage, dark decay, light-sensitivity) and little fluctuation due to environmental conditions, in particular, moisture.

In addition, various known additives for electrophotographic photoreceptive layers, such as chemical sensitizers, etc., can be used, if needed. Examples of such additives include electron accepting compounds (e.g., halogens, benzoquinones, chloranil, acid anhydrides, organic carboxylic acids) as described in *Imaging,* No. 8, p. 12 (1973), and polyarylalkane compounds, hindered phenol compounds and p-phenylenediamine compounds as described in Hiroshi Komon, *Saikin no Kodendo Zairyo to Kankotai no Kaihatsu Jitsuyoka* (Recent Development and Practical Use of Photoconductive Materials and Photoreceptors), chaps. 4–6, Nippon Kagaku Joho K.K. Shuppanbu (1986).

There is no particular restriction on the addition amounts of these additives, but they are usually added in amounts ranging from 0.0001 to 2.0 parts by weight per 100 parts by weight of the photoconductive material used.

A preferred thickness of the photoconductive layer is from 1 to 100 microns, particularly from 10 to 50 microns.

When the photoconductive layer is used as a charge generating layer for an integrated type photoreceptor which comprises a charge generating layer and a charge transporting layer in combination, a thickness of the charge generating layer is preferably from 0.01 to 1 micron, particularly from 0.05 to 0.5 micron.

The photoconductive layer of this invention can be formed on a support of conventional use in the art. In general, the support for the electrophotographic photoreceptive layer is preferably electrically conductive. Conductive supports which can be used in the present invention include the same ones as used in conventional photoreceptors, e.g., metals, base materials (such as paper and plastic sheets) to which electric conductivity is imparted by impregnation with a low resistance material, base materials the back surface (or the surface opposite to what has thereon a photoreceptive layer) of which is rendered conductive and further coated with at least one layer for the purpose of prevention of curling, the aforesaid supports which further have a waterproofing adhesive layer on the surface thereof, the aforesaid supports which further have one or more (if desired) pre-coats, papers laminated with an Al-evaporated conductive plastic film or the like, etc.

More specifically, conductive materials for use in the present invention are described in Yukio Sakamoto, *Denshi Shashin* (*Electrophotography*), Vol. 14, No. 1, pp. 2–11 (1975), Hiroyuki Moriga, *Nyumon Tokushushi no Kagaku* (Introduction to Chemistry of Specific Papers), Kobunshi Kanko Kai (1975), M. F. Hoover, *J. Macromol. Sci. Chem.,* A-4 (6), pp. 1327–1417 (1970), etc.

The production of a printing plate from the lithographic printing plate precursor of the present invention can be carried out by a conventional procedure. The solution which can be used for the oil-desensitization treatment are well known in the art as described in, for example, JP-B-47-32681, JP-B-55-9315, JP-B-46-21244, JP-B-46-7106, JP-A-52-502, JP-B-45-24609, JP-A-57-2796, JP-A-57-20394, JP-A-53-83807, JP-A-

53109701, JP-A-52-126302, JP-B-40-763, JP-B-47-29642, JP-B-43-28404, JP-A-51-118501, etc.

More specifically, the oil-desensitizing solution in an aqueous solution comprising an agent which renders the non-image are hydrophilic as a main component, and other various additives such as a pH-adjusting agent, a buffering agent, etc. The hydrophilicity-providing agent can be any of conventionally known agents used for this purpose, for example, ferrocyanides are phosphates, phytic acid salts, aqueous polymers having a chelating ability, metal complexes, etc. The pH-adjusting agents are buffering agents can be any of known inorganic acids, organic acids or salts thereof, alone or as a mixture thereof. Examples of such agents include formic acid, acetic acid, butyric acid, valeric acid, lactic acid, tartaric acid, propionic acid, oxalic acid, malonic acid, succinic acid, glutaric acid, maleic acid, phthalic acid, citraconic acid, itaconic acid, fumaric acid, tricarboxylic acid, glycolic acid, thioglycolic acid, malic acid, citric acid, gluconic acid, pilvic acid, glycollic acid, salicylic acid, adipic acid, hydroacrylic acid, glyceric acid, p-toluenesulfonic acid and their metal salts, and organic amine salts.

Further, when the main agent of the oil-desensitizing solution is a ferrocyanide, a chelating agent such as EDTA-2Na or a reducing agent such as a sulfite can be preferably added to the oil-desensitizing solution in order to retain an ability to render hydrophilic and also to prevent precipitation.

Also, when the main agent of the oildesensitizing solution is a phytic acid salt, it is preferred to add a water-soluble cationic polymer as described in JP-A-60-23099 and a lower molecular weight electrolyte to the solution in order to decrease the generation of stains.

In addition, a wetting agent or dampening agent can also be incorporated into the oil-desensitizing solution, and examples of such agents include ethylene glycol, diethylene glycol, triethylene glycol, polyethylene glycol, glycerin, gum arabic, carboxymethyl cellulose, acrylic polymers, benzyl alcohol, cyclohexyl alcohol, propargyl alcohol, methanol, ethanol, iso- and n-propyl alcohols, triethanolamine, etc.

Further, preservatives such as salicylic acid, phenol, phenol butyl p-benzoate, sodium dehydroacetate, 4-isothiazolon-3-one, and the like can be added to the oil-desensitizing solution.

Furthermore, anti-rusting agents such as sodium nitrite, dicyclohexylammonium nitrite, etc. can be added to the oil-desensitizing solution.

In the oil-desensitizing treatment used in the present invention, an additional treatment for rendering the resin binder of the present invention hydrophilic may be conducted before or after the treatment with the above oil-desensitizing solution. The above additional treatment can be effected with an aqueous acidic solution or an aqueous alkaline solution.

The aqueou acidic solution comprises the inorganic or organic acid or the salt thereof, alone or as a mixture thereof, as described for the oil-desensitizing solution, and the aqueous alkaline solution comprises an inorganic compound such as sodium hydroxide, ammonia, sodium bicarbonate, sodium carbonate, sodium sulfite, sodium bisulfite, ammonium bisulfite, etc. or an organic basic compound such as trimethylamine, pyridine, piperidine, morpholine, ethanolamine, triethanolamine, hydrazine, etc., alone or as a mixture thereof.

Either the above-described aqueous acidic or alkaline solution may contain a water-soluble organic solvent such as the alcohols as described above for the wetting agents or dampening agents, ketones such as acetone, methyl ethyl ketone, etc., ethers such as tetrahydrofuran, dioxane, trioxane, etc. Further, the solution may contains other additives as described for the oil-desensitizing solution.

The acidic compounds or basic compounds as main agents used for the treatment for rendering the resin binder hydrophilic are preferably contained in an amount of from about 0.1 to about 1 mol per liter of the treating solution. If the organic solvent in incorporated into the treating solution, it is preferably used in a proportion of about 5 to about 50% by volume based on the total volume of the treating solution.

The oil-desensitizing treatment can be carried out at a temperature of about 10° C. to about 50° C., preferably from 20° C. to 35° C., for a period of not longer than about 5 minutes. Upon subjecting the oil-desensitizing treatment, the hydrophilic group-producing functional groups are converted into hydrophilic groups by hydrolysis or hydrogenolysis.

This invention is illustrated in greater detail by reference to the following examples. However, the invention is not limited to these examples.

EXAMPLE 1 AND COMPARATIVE EXAMPLES A TO C

After heating a mixture of 73.3 g of benzyl methacrylate, 25 g of the following monomer compound (A), 0.2 g of acrylic acid, 1.5 g of divinylbenzene and 300 g of toluene to 75° C. in a nitrogen gas stream, 1.0 g of 2,2'-azobisisobutyronitrile (AIBN) was added to the mixture and this mixture was reacted for 8 hours. The copolymer (1) thus obtained had a weight average molecular weight of 100,000.

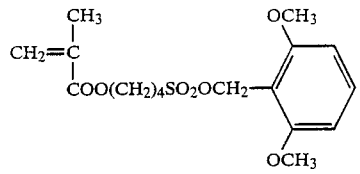

Monomer (A)

Subsequently, a mixture of 40 g (as solid component) of the copolymer, 200 g of zinc oxide, 0.05 g of rose bengale, 0.01 g of phthalic anhydride and 300 g of toluene was dispersed in a ball mill for 2 hours to provide a coating composition for a photosensitive layer. The coating composition was coated on a paper subjected to a conductive treatment by means of a wire bar so that the dry coated amount became 25 g/m$^2$. The coated paper was dried at 110° C. for one minute, and then allowed to stand for 24 hours in the dark under the condition of 20° C. and 65% RH. Thus, an electrophotographic photosensitive material was obtained.

By following the same procedure as above except that the following copolymer was used in preparation of the coating composition, electrophotographic Comparative Photosensitive Materials A, B and C were prepared.

Comparative Photosensitive Material A

By following the same procedure as for Example 1 except that a mixture of 74.8 g of benzyl methacrylate, 25 g of the monomer compound (1), 0.2 g of acrylic acid and 300 g of toluene was used and heated to 60° C. and 0.5 g of AIBN was added to the mixture, Copolymer (2)

having a weight average molecular weight of 80,000 was obtained. Subsequently, the same procedure as in Example 1 was repeated except that the Copolymer (2) was used in place of the Copolymer (1), and Comparative Photosensitive Material A was prepared.

Comparative Photosensitive Material B

By following the same procedure as in Comparative Example A except that a mixture of 95 g of benzyl methacrylate, 5 g of the following monomer compound (B), 100 g of toluene and 100 g of isopropyl alcohol was used and heated to 75° C. and 2.0 g of AIBN was added to the mixture, Copolymer (3) having a weight average molecular weight of 28,000 was obtained.

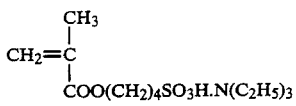

Monomer (B)

Subsequently, the same procedure as in Example 1 was repeated to prepare Comparative Photosensitive Material (B).

Comparative Photosensitive Material C

By following the same procedure as in Example 1 except that 40 g of benzyl methacrylate/acrylic acid (99.8/0.2, by weight) copolymer (weight average molecular weight: 83,000) was used as the binder resin in the photoconductive layer, Comparative Photosensitive Material C was prepared.

In Comparative Example B, when the content of the Compound (2) in the copolymer was 5% by weight or more, coagulated solids formed in the step of preparing the photosensitive layer forming dispersion so that a dispersion suitable for coating could not be prepared. Further in Comparative Example B, when the proportion of the monomer components was varied to form a copolymer having a weight average molecular weight of 50,000 or more, the same phenomenon as above also occurred, so that a coated film could not be formed.

The film-surface property (smoothness of the surface), the electrostatic characteristics, the oil-desensitizing property (shown by the contact angle of the photosensitive layer with water after being oil-desensitized) and the printing properties (background stain, printing durability, etc.) of each of these electrophotographic photosensitive materials were determined. The printing properties were determined as follows. That is, the photosensitive material was imagewise exposed and developed using an automatic camera processor ELP 404V (trade name, product of Fuji Photo Film Co., Ltd.) and a developer (toner) ELP T (trade name, product of Fuji Photo Film Co., Ltd.) to form images, the photoconductive layer thus developed was etched by an etching processor using an oil-desensitizing solution ELP-E (trade name, product of Fuji Photo Film Co., Ltd.) to provide a lithographic printing plate, and the above-described properties were determined using the printing plate. A Hamada Star Type 800SX (trade name, product of Hamada Star K.K.) was used as the printing machine.

The results obtained are shown in Table 1 below.

TABLE 1

| | Example 1 | Comparative Example A | Comparative Example B | Comparative Example C |
|---|---|---|---|---|
| Smoothness of Photoconductive Layer*1 (sec/cc) | 85 | 85 | 10 to 20 | 100 |
| Electrostatic Characteristics*2 | | | | |
| Vo (−V) | 560 | 550 | 430 | 500 |
| $E_{1/10}$ (lux · sec) | 8.5 | 8.5 | 7.2 | 9.0 |
| Contact Angle with Water*3 (degree) | 5 or less | 5 or less | 20 to 35 (noticeable fluctuation) | 20 to 30 (noticeable fluctuation) |
| Property of Reproduced Image*4 | | | | |
| I: ordinary temperature nd humidity | A | A | B | B |
| II: high temperature and humidity | A | A | D | C |
| Background Stain of Print*5 | | | | |
| I: | A | A | C | C |
| II: | More than 10,000 prints free from background stain | Background stain was generated from the 7,000th print | Background stain was generated from the 1st print | Background stain was generated from the 1st print |

The terms shown in Table 1 were evaluated as follows.

*1Smoothness of Photoconductive Layer: The smoothness (sec/cc) of each photosensitive material was measured using a Beck smoothness test machine (made by Kumagaya Riko K.K.) under the conditions of an air volume of 1 cc.

*2Electrostatic Characteristics: After applying a corona discharging of −6 KV onto the surface of each photosensitive material for 20 seconds using a paper analyzer (Paper Analyzer Type SP-428, trade name, made by Kawaguchi Denki K.K.) in a dark room kept at 20° C. and 65% RH, the photosensitive material was allowed to stand for 10 seconds and then the surface potential ($V_{10}$ in this case) was measured. Then, the surface of the photoconductive layer was irradiated by visible light of 20 lux, the time required to reduce the surface potential ($V_{10}$) to 1/10 thereof was measured, and the exposure amount $E_{1/10}$ (lux · sec) was calculated therefrom.

*3Contact Angle with Water: After oil-desensitizing the surface of each photoconductive layer by passing each of the photosensitive materials through an etching processor using an oil-desensitizing solution ELP-E (trade name, product of Fuji Photo Film Co., Ltd.), a water drop of 2 ml of distilled water was placed on the surface and the contact angle of the water drop formed was measured by means of a goniometer.

*4Property of Reproduced Image: After allowing each photosensitive material to stand for a whole day and night under the condition of ordinary temperature and humidity (20° C., 65% RH), the photosensitive material was processed (imagewise exposure, development and fixing) under the condition using an automatic camera processor ELP-404V (trade name, a product of Fuji Photo Film Co., Ltd.) The properties of the images electrophotographically obtained on the photosensitive material (fog and image quality) were evaluated visually. (This is Item I.) For Item II, the processing was effected under more severe conditions of high temperature and high humidity (30° C., 80% RH), and the others were same as those for Item I.

*5Background Stain of Print: By processing each photosensitive material using an automatic camera processor ELP 404V (trade name, product of Fuji Photo Film Co., Ltd.), toner images were formed to provide a printing plate. The surface of the printing plate was desensitized as the case of *3 described above, printing was applied on 500 sheets of wood free paper using the printing plate as offset master by means of an offset printing machine (Hamada Star Type 800SX, trade name,product of Hamada Star K.K.), and the background stain was evaluated visually on all the prints. The stain is defined as Background Stain I of the print.

The terms shown in Table 1 were evaluated as follows. *1): Smoothness of Photoconductive Layer:

The smoothness (sec/cc) of each photosensitive material was measured using a Beck smoothness test machine (made by Kumagaya Riko K.K.) under the conditions of an air volume of 1 cc. *2): Electrostatic Characteristics:

After applying a corona discharging of −6 KV onto the surface of each photosensitive material for 20 seconds using a paper analyzer (Paper Analyzer Type SP-428, trade name, made by Kawaguchi Denki K.K.) in a dark room kept at 20° C. and 65% RH, the photosensitive material was allowed. to stand for 10 seconds and then the surface potential ($V_{10}$ in this case) was measured. Then, the surface of the photoconductive layer was irradiated by visible light of 20 lux, the time required to reduce the surface potential ($V_{10}$) to 1/10 thereof was measured, and the exposure amount $E_{1/10}$ (lux.sec) was calculated therefrom. *3) Contact Angle with Water:

After oil-desensitizing the surface of each photoconductive layer by passing each of the photosensitive materials through an etching processor using an oil desensitizing solution ELP-E (trade name, product of Fuji Photo Film Co., Ltd.), a water drop of 2 ml of distilled water was placed on the surface and the contact angle of the water drop formed was measured by means of a goniometer. *4) Property of Reproduced Image:

After allowing each photosensitive material to stand for a whole day and night under the condition of ordinary temperature and humidity (20° C., 65%RH), the photosensitive material was processed (imagewise exposure, development and fixing) under the condition using an automatic camera processor ELP-404V (trade name, a product of Fuji Photo Film Co., Ltd.). The properties of the images electrophotographically obtained on the photosensitive material (fog and image quality) were evaluated visually. (This is Item I.) For Item II, the processing was effected under more severe conditions of high temperature and high humidity (30° C., 80%RH), and the others were same as those for Item I. *5) Background Stain of Print:

By processing each photosensitive material using an automatic camera processor ELP 404V (trade name, product of Fuji Photo Film Co., Ltd.), toner images were formed to provide a printing plate. The surface of the printing plate was desensitized as the case of *3) described above, printing was applied on 500 sheets of wood free paper using the printing plate as offset master by means of an offset printing machine (Hamada Star Type 800SX, trade name, product of Hamada Star K.K.), and the background stain was evaluated visually on all the prints. The stain is defined as Background Stain I of the print.

Background Stain II of the print was evaluated in the same manner as Background Stain I except that the desensitizing solution was diluted with five times, the dampening water at printing was diluted with two times, and the printing pressure in the printing machine was somewhat increased. That is, the case of Background Stain II corresponds to the case of printing under more severe conditions than the case of Background Stain I.

The ranks used for evaluating the property of reproduced image and background stain of prints are as follows:

Image Quality

A: Clear image without background stains
B: Slight background stains
C: Fair amount of background stains and deficiency in fine lines of the reproduced letters
D: Remarkable background stains, decreased density in the image area, and apparent deficiency in the reproduced letters Background Stains of Prints A: No stains
B: Slight spot-like stains
C: Fair amount of stains
D: Remarkable stains
E: Stained over entire surface The electrophotographic images formed by using the Photosensitive Material of Example 1 and Comparative Photosensitive Material A had a sharp image quality, while the images formed by using Comparative Photosensitive Material B could not. This is because the smoothness of the surface of the Photoconductive layer was extremely poor and the non-image areas had noticeable fogs in the case of Comparative Photosensitive Material B. When Comparative Photosensitive Materials B and C were processed under the condition of 30° C. and 80% RH, the image quality of the electrophotographic images formed was extremely poor. (Precisely, background stain occurred and the image density was 0.6 or less.)

Regarding the contact angle of the oil-desensitized photosensitive material with water, the value was small to be 5 degrees or less in the materials of Photosensitive Material of Example 1 and Comparative Photosensitive Material A. This means that these materials were rendered sufficiently hydrophilic.

When these photosensitive materials were used as photosensitive plates for an offset master and printing was practiced using these printing plates, no background stain was observed in the non-image areas only in the plates of Photosensitive Material of Example 1 and Comparative Photosensitive Material A. These plates were considered good in this respect. However, when these plates were subjected to printing testing under the conditions of an increased printing pressure (severe condition) to obtain 10,000 prints, the plate produced using the Photosensitive Material of Example 1 formed 10,000 prints with good image quality and with no background stain while the plate produced using Comparative Photosensitive Material A formed backgroundstained prints after 7,000 prints. The plates produced using Comparative Photosensitive Materials B and C formed background-stained prints from the first print.

From these facts, it is concluded that only the Photosensitive Material of Example 1 (of the invention) could be used to form a sharp electrophotographic image even when this was processed under various ambient conditions and the plate thus formed from the Photosensitive Material of Example 1 only could duplicate 10,000 or more prints with no background stain.

EXAMPLES 2 TO 14

By following the same procedure as Example 1 except that copolymers shown in Table 2 were used in place of the Resin (1) of the invention, various electrophotographic photosensitive materials were prepared.

TABLE 2

| Example No. | Resin No. | Monomers Forming Copolymers and Composition ratio thereof (by weight) 75 wt % | 25 wt % | 1.5 wt % |
|---|---|---|---|---|
| 2 | [4] | $CH_2=C(CH_3)COOC_4H_9$ | $CH_2=CH-COO(CH_2)_2SCOCH_2Cl$ | $CH_2=C(CH_3)COO(CH_2)_2OCOC(CH_3)=CH_2$ |
| 3 | [5] | $CH_2=C(CH_3)COOC_4H_9$ | $CH_2=C(CH_3)COO(CH_2)_2S-COOC_2H_5$ | $CH_2=C(CH_3)COOCH_2CH=CH_2$ |
| 4 | [6] | $CH_2=C(CH_3)COOC_2H_5$ | $CH_2=C(CH_3)COO(CH_2)_2S-Si(C_2H_5)_3$ | $CH_2=C(CH_3)COO(CH_2)_2COO-CH=CH_2$ |
| 5 | [7] | $CH_2=C(CH_3)COOC_4H_9$ | $CH_2=C(CH_3)COOCH_2CH(SCSOC_2H_5)CHS-CSOC_2H_5$ | $CH_2=C(OCO(CH_2)_6COO)CH=CH_2$ |
| 6 | [8] | $CH_2=C(CH_3)COOC_4H_9$ | 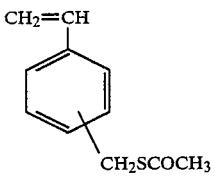 | $CH_2=C(CH_3)COO(CH_2O)_{72}COC(CH_3)=CH_2$ |
| 7 | [9] | 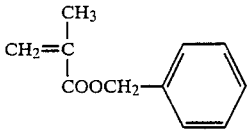 | 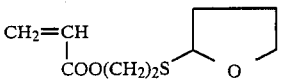 | 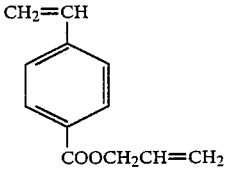 |
| 8 | [10] | $CH_2=C(CH_3)COOC_4H_9$ | $CH_2=C(CH_3)COO(CH_2)_2O-P(=O)(O-Si(C_2H_5)_3)OC_2H_5$ | $CH_2=CH-CONH(CH_2)_4OCO-CH=CH_2$ |
| 9 | [11] | $CH_2=C(CH_3)COOC_2H_5$ | $CH_2=C(CH_3)COO(CH_2)_2NHCOO(CH_3)_3$ | $(CH_2=C(CH_3)COOCH_2)_3C-C_2H_5$ |
| 10 | [12] | $CH_2=C(CH_3)COOC_2H_5$ | $CH_2=C(CH_3)COO(CH_2)_2NHCOOCH_2$ 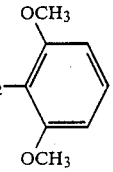 | 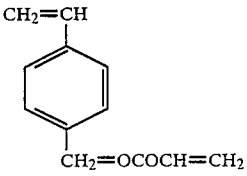 |
| 11 | [13] | $CH_2=C(CH_3)COOC_3H_7$ | $CH_2=C(CH_3)COO(CH_2)_2N=CH-C_6H_4-OCH_3$ | $CH_2=C(CH_3)COO(CH_2)_3SO_2OCH_2CH=CH_2$ |

TABLE 2-continued

| Example No. | Resin No. | Monomers Forming Copolymers and Composition ratio thereof (by weight) 75 wt % | 25 wt % | 1.5 wt % |
|---|---|---|---|---|
| 12 | [14] | $CH_2=C(CH_3)COOC_4H_9$ | $CH_2=CH$ 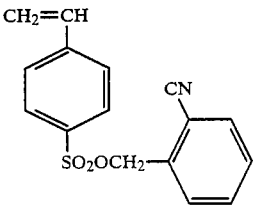 | $CH_2=CH-SO_2NH(CH_2)_2OCOCH=CH(CH_3)$ |
| 13 | [15] | $CH_2=C(CH_3)COOC_4H_9$ | $CH_2=C(CH_3)COO(CH_2)_4SO_2OCH(C_6H_5)_2$ | $CH_2=C(CH_3)COO(CH_2CH_2O)_2COC(CH_3)=CH$ |
| 14 | [16] | $CH_2=C(CH_3)COOC_2H_5$ | $CH_2=C(CH_3)COO(CH_2)_6SO_2OCH_2OCH_2-$ 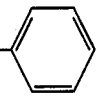 | $CH_2=CH$ 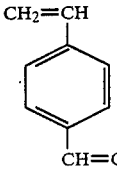 $CH=CH_2$ |

These materials were processed in the same manner as in Example 1, using the same apparatus as in Example 1, the density of the offset master plates obtained was 1.0 or more and the image quality thereof was sharp and good. Next, these plates were etched to obtain printing plates. Using each of the thus prepared printing plates, 10,000 prints were obtained having a sharp image quality with no fog.

On the other hand, these materials were allowed to stand under conditions of 45° C. and 75% RH for 2 weeks and then subjected to the sam procedure as above. As a result, no change in the master plates and the prints was obtained.

EXAMPLE 15

After heating a mixture of 72 g of benzyl methacrylate, 20 g of the aforesaid Compound (1), 8 g of N-methoxymethyl methacrylamide, 200 g of toluene and 50 g of isopropyl alcohol to 75° C. in a nitrogen gas stream, 2 g of AIBN was added to the mixture and this mixture was reacted for 8 hours. Then the temperature was elevated up to 100° C. and the reaction was continued for further 2 hours with removing the isopropyl alcohol-azeotropic mixture by azeotropic distillation.

The copolymer (17) thus obtained had a weight average molecular weight of 98,000.

By following the same procedure as in Example 1 except that the copolymer (17) was used in place of the copolymer (1) in Example 1, an electrophotographic photosensitive material was prepared.

The photosensitive material was processed (imagewise exposed and developed) in the same manner as in Example 1, using the same automatic camera processor ELP 404V. The offset printing master plate thus prepared had a density of 1.0 or more and a sharp image quality. Next, the master plate was etched to provide a lithographic printing plate. This was used for printing to give 10,000 prints, all of which had a sharp image having no background stain in the non-image areas.

EXAMPLE 16 AND COMPARATIVE EXAMPLE D

After heating a mixture of 60 g of ethyl methacrylate, 20 g of Monomer (C) having the following structural formula and 500 g of toluene to 60° C. in a nitrogen stream, 0.1 g of 2,2'-azobisvaleronitrile was added to the mixture and this mixture was reacted for 8 hours. The copolymer (18) thus obtained had a weight average molecular weight of 53,000.

Monomer (C)

$$CH_2=C(CH_3)COO(CH_2)_4SO_2OCH_2CHCl_2$$

Subsequently, a mixture of 30 g (as solid component) of the copolymer, 10 g of butyl acrylate/acrylic acid (99/1, by weight) copolymer (weight average molecular weight: 45,000), 200 g of zinc oxide, 0.05 g of rose bengale, 0.01 g of phthalic anhydride and 300 g of toluene was dispersed in a ball mill for 2 hours.

Next, 10 g of allyl methacrylate and 0.5 g of 2,2'-azobisisobutyronitrile were added to the dispersion and further dispersed in a ball mill for 10 minutes to provide a coating composition for a photosensitive layer. The coating composition was coated on a paper subjected to a conductive treatment by means of a wire bar so that the dry coated amount became 25 g/m$^2$. The coated paper was dried at 100° C. for 30 minutes, and then allowed to stand for 24 hours in the dark under the condition of 20° C. and 65% RH. Thus, an electrophotographic photosensitive material was obtained.

Comparative Example D

After heating a mixture of 80 g of ethyl methacrylate, 20 g of Monomer (C) and 200 g of toluene to 75° C. in a nitrogen gas stream, 1.0 g of 2,2'-azobisisobutyronitrile was added to the mixture and this mixture was reacted for 8 hours. The copolymer (19) thus obtained had a weight average molecular weight of 45,000.

Subsequently, a coating composition was prepared by following the same procedure as in Example 16 except that the copolymer (19) obtained above was used in place of the copolymer (18). The composition was dispersed in a ball mill for 2 hours in the same manner as in Example 1. The coating composition (for a photosensitive layer) thus obtained was coated on a paper subjected to a conductive treatment by means of a wire bar so that the dry coated amount became 25 g/m$^2$. The coated paper was dried at 110° C. for one minute, and then allowed to stand for 24 hours in the dark under the conditions of 20° C. and 65% RH. Thus, an electrophotographic photosensitive material was obtained.

Various characteristics of each of the thus prepared photosensitive materials were determined in the same manner as in Example 1. The offset printing master plate obtained by using each of the Photosensitive Material of Example 16 and Comparative Photosensitive Material D had a density of 1.0 or more and a sharp image quality. Next, the master plates were etched to provide lithographic printing plates. These plates were used for printing to give 10,000 prints, whereupon the plate of the present invention (Photosensitive Material of Example 16) gave 10,000 prints having a sharp image quality and having no background stain while the comparative plate of Comparative Photosensitive Material D gave prints with noticeable background stains after 7,000 prints.

EXAMPLES 17 TO 22

By following the same procedure as Example 16 except that copolymers shown in Table 3 were used in place of the Resin (18) of the invention, various electrophotographic photosensitive materials were prepared.

TABLE 3

$$\left(CH_2-\underset{\underset{COOC_4H_9}{|}}{\overset{\overset{CH_3}{|}}{C}}\right)_{55}\left(CH_2-\underset{\underset{COO(CH_2)_4SO_2OCH_2CHFCH_2F}{|}}{\overset{\overset{CH_3}{|}}{C}}\right)_{25}(Y)_{20}$$

| Example No. | Resin No. | Copolymer Component Y | Weight Average Molecular Weight |
|---|---|---|---|
| 17 | 20 | $\left(CH_2-\underset{\underset{COOCH=CH_2}{\vert}}{\overset{\overset{CH_3}{\vert}}{C}}\right)$ | 54,000 |
| 18 | 21 | $\left(CH_2-\underset{\underset{COO(CH_2)_2OCOCH=CH}{\vert}}{\overset{\overset{CH_3}{\vert}}{C}}\right)$ $\overset{\overset{CH_3}{\vert}}{CH}$ | 63,000 |
| 19 | 22 | $\left(CH_2-\underset{\underset{COO(CH_2)_2COOCH=CH_2}{\vert}}{\overset{\overset{CH_3}{\vert}}{C}}\right)$ | 76,000 |
| 20 | 23 | $\left(CH_2-CH\right)$ 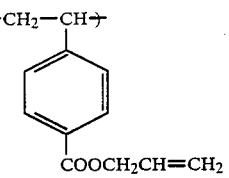 | 45,000 |

TABLE 3-continued $$\left(CH_2-\underset{\underset{COOC_4H_9}{|}}{\overset{\overset{CH_3}{|}}{C}}\right)_{55}\left(CH_2-\underset{\underset{COO(CH_2)_4SO_2OCH_2CHFCH_2F}{|}}{\overset{\overset{CH_3}{|}}{C}}\right)_{25}(Y)_{20}$$

| Example No. | Resin No. | Copolymer Component Y | Weight Average Molecular Weight |
|---|---|---|---|
| 21 | 24 | $\left(CH_2-CH\right)$ 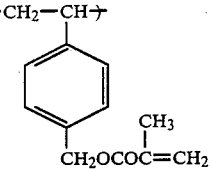 | 28,000 |
| 22 | 25 | $\left(CH_2-\underset{\underset{COO(CH_2)_2SO_2OCH_2CH=CH_2}{\vert}}{\overset{\overset{CH_3}{\vert}}{C}}\right)$ | 35,000 |

Each of these materials was processed in the same manner as in Example 1, using the same processor. All the offset printing master plates thus prepared had a density of 1.0 or more and a sharp image quality. Next, each of the master plates was etched to provide a lithographic printing plate. Each of these plates thus prepared was used for printing to give 10,000 prints, all of which had a sharp image quality with no fog.

EXAMPLE 23

After heating a mixture of 60 g of n-propyl methacrylate, 15 g of the above-described Monomer (A), 25 g of allyl methacrylate, 0.3 g of acrylic acid and 200 g of toluene to 70° C. in a nitrogen gas stream, 1.5 g of 2,2'-azobis(2,4-dimethylvaleronitrile) was added to the mixture and this mixture was reacted for 10 hours. The copolymer (26) thus obtained had a weight average molecular weight of 96,000. Subsequently, the same process as in Example 1 was repeated except that 40 g of the copolymer (26) obtained above was used in place of the copolymer (1) used in Example 1, to provide a dispersion for forming a photosensitive layer. Then the same process as in Example 1 was further repeated except that the drying was effected at 100° C. for one hour, to provide an electrophotographic photosensitive material.

The material thus prepared was processed in the same manner as in Example 1, using the same automatic camera processor ELP 404V. The offset printing master plate thus prepared had a density of 1.0 or more and a sharp image quality. Next, the master plate was etched to provide a lithographic printing plate. Thus was used for printing to give 10,000 prints, all of which had a sharp image having no background stain in the non-image areas.

EXAMPLE 24

By following the same procedure as Example 23 except that 15 g of each of Copolymers (27) and (28) having the following chemical structures was used, two different electrophotographic photosensitive materials were prepared.

Copolymer (27)(weight average molecular weight of 43,000):

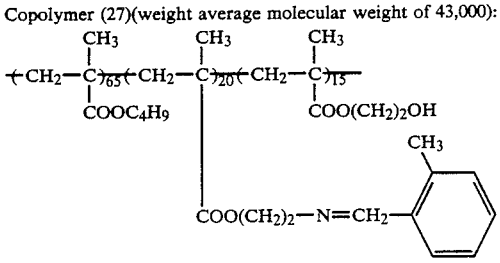

Copolymer (28) (weight average molecular weight of 38,000):

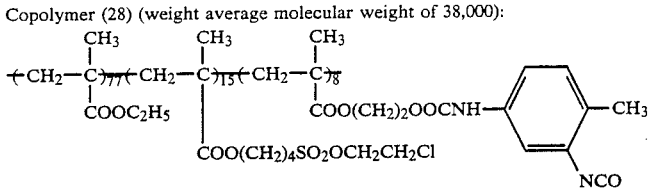

Each of these materials was processed in the same manner as in Example 1, using the same processor. Next, the master plates thus prepared were etched to provide printing plates. Both the offset printing master plates had a density of 1.0 or more and a sharp image quality. Each of the printing plates thus prepared was used for printing to give 10,000 prints, all of which had a sharp image quality with no background fog.

EXAMPLE 25 AND COMPARATIVE EXAMPLES E AND F

After heating a mixture of 30 g of ethyl methacrylate, 40 g of Monomer (D) having the following chemical structure, 30 g of allyl methacrylate and 500 g of toluene to 60° C. in a nitrogen gas stream, 1.0 g of 2,2'-azobisvaleronitrile was added to the mixture and this mixture was reacted for 8 hours. The copolymer (I) thus obtained had a weight average molecular weight of 62,000.

Monomer (D)

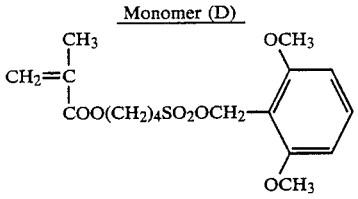

Subsequently, a mixture of 30 g (as solid content) of the copolymer, 10 g of butyl methacrylate/acrylic acid (99/1, by weight) copolymer (weight average molecular weight: 45,000), 200 g of zinc oxide, 0.05 g of rose bengale, 0.01 g of phthalic anhydride and 300 g of toluene was dispersed in a ball mill for 2 hours.

Next, 10 g of allyl methacry-late and 0.5 g of 2,2'-azobisisobutyronitrile were added to the dispersion and further dispersed in a ball mill for 10 minutes to provide a coating composition for a photosensitive layer. The coating composition was coated on a paper subjected to a conductive treatment by means of a wire bar so that the dry coated amount became 25 g/m$^2$. The coated paper was dried at 100° C. for 30 minutes, and then allowed to stand for 24 hours in the dark under the conditions of 20° C. and 65% RH. Thus, an electrophotographic photosensitive material was obtained.

Comparative Photosensitive Material E

After heating a mixture of 60 g of ethyl methacrylate, 40 g of Monomer (D) and 200 g of toluene to 75° C. in a nitrogen gas stream, 1.0 g of 2,2'-azobisisobutyronitrile was added to the mixture and this mixture was reacted for 8 hours. The copolymer (A) thus obtained had a weight average molecular weight of 45,000.

Subsequently, the same process as in Example 25 was repeated except that the said Copolymer (A) was used in place of the Copoymer (29) used in Example 25, and the resulting composition was first dispersed in a ball mill for 2 hours to provide a coating composition for forming a photosensitive layer. The composition thus obtained was coated on a paper subjected to a conductive treatment by means of a wire bar so that the dry coated amount became 25 g/m$^2$. The coated paper was dried at 110° C. for one minute, and then allowed to stand in the dark under the condition of 20° C. and 65% RH for 24 hours. Thus, an electrophotographic photosensitive material was obtained.

Comparative Photosensitive Material F

By following the procedures used to produce Comparative Photosensitive Material E except that a mixture of 99 g of ethyl methacrylate, 1 g of 4-sulfobutyl methacrylate and 200 g of toluene was used, Copolymer (B) having a weight average molecular weight of 48,000 was obtained. Next, the same process as used for Comparative Photosensitive Material E was repeated except that the said Copolymer (B) was used in place of the Copolymer (A), and an electrophotographic photosensitive material was obtained.

The film-surface property (smoothness of surface) and the electrostatic characteristics of each of these electrophotographic photosensitive materials and also the photographic property thereof under normal conditions and under ambient conditions of 30° C. and 80% RH were determined. Furthermore, each of the photosensitive materials was used as an offset master and the oil-desensitizing property (shown by the contact angle of the photosensitive layer with water after being oildesensitized) of the photoconductive layer and the printing properties (background stain, printing durability, etc.) thereof were determined.

The photographic property and the printing properties were determined as follows. That is, the photosensitive material was imagewise exposed and developed using an automatic camera processor ELP 404V (trade name, product of Fuji Photo Film Co., Ltd.) and a developer (toner) ELP-T (trade name, product of Fuji Photo Film Co., Ltd.) to form images, the photoconductive layer thus developed was etched by an etching processor using an oil-desensitizing solution ELP-E (trade name, product of Fuji Photo Film Co., Ltd.) to provide a lithographic printing plate, and the abovedescribed properties were determined using the printing plate. Hamada Star Type 800SX (trade name, product of Hamada Star K.K.) was used as the printing machine.

The results obtained are shown in Table 4 below.

TABLE 4

| | Example 25 | Comparative Example E | Comparative Example F |
|---|---|---|---|
| Smoothness of Photoconductive Layer*1 (sec/cc) | 85 | 85 | 55 |
| Electrostatic Characteristics*2 | | | |
| Vo (−V) | 580 | 575 | 450 |
| DRR (%) | 90 | 91 | 60 |
| $E_{1/10}$ (luz · sec) | 8.3 | 8.4 | 4.5 |
| Photographic Property*3 | | | |
| I: at 20° C. and 65% RH | Good | Good | Dm: Unmeasurable |
| II: at 30° C. and 80% RH | Good | Good | Dm: Unmeasurable |
| Contact Angle with Water*4 (degree) | 5 or less | 5 or less | 32 |
| Background Stain of Print*5 | | | |
| I: | A | A | D |
| II: | A | A | E |
| Printing Durability*6 | More than 10,000 prints | 7,000 prints | Background stain was generated from 1st print |

The evaluations were same as those in Table 1 above.

From the results shown in Table 4, it can be seen that the photosensitive material of this invention (Photosensitive Material of Example 25) and the comparative material E (Comparative Photosensitive Material E) were better in the smoothness and electrostatic characteristics of the photoconductive layer and also gave prints having no background fog and clear images.

However, the smoothness of the surface of the photoconductive layer of the comparative material F (Comparative Photosensitive Material F) was extremely poor and the Comparative Material F gave poor prints having noticeable fog in the non-image areas thereof. The images formed were not sharp.

Regarding the contact angle of the oildesensitized photosensitive material with water, the value was small as 5 degrees or less in the materials of Example 25 and Comparative Photosensitive Material E. This means that these materials were rendered sufficiently hydrophilic.

When these photosensitive materials were used as photosensitive plates for an offset master and printing was practised using these printing plates, no background stain was observed in the non-image areas only in the plates produced from the Photosensitive Material of Example 25 and that produced from Comparative Photosensitive Material E. These plates were considered good in this respect. However, when these plates were subjected to printing test under the condition of an increased printing pressure (severe condition) to obtain 10,000 prints, the plate of produced from the Photosensitive Material of Example 25 formed 10,000 prints with good image quality and with no background stain while the plate produced from Comparative Photosensitive Material E formed background-stained prints after 7,000 prints. The plate produced from Comparative Photosensitive Material F formed background-stained prints from the first print.

From these results, it is concluded that only the Photosensitive Material of Example 25 (of the invention) could form a sharp electrophotographic image even when this was processed under various ambient conditions and the plate thus formed from the Photosensitive Material of Example 25 only could duplicate 10,000 or more prints with no background stain.

EXAMPLES 26 TO 36

By following the same procedure as Example 25 except that copolymers shown in Table 5 were used in place of the Copolymer (I), various electrophotographic photosensitive materials were prepared.

TABLE 5

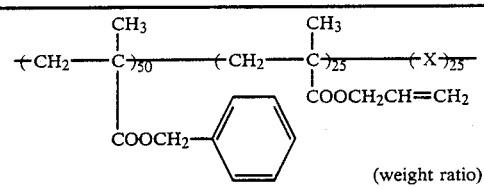

(weight ratio)

| Example No. | Resin No. | Co-monomer X | Weight Average Molecular Weight |
|---|---|---|---|
| 26 | II | 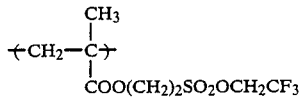 | 18,000 |
| 27 | III | 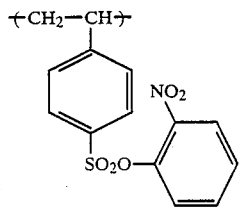 | 23,000 |
| 28 | IV | 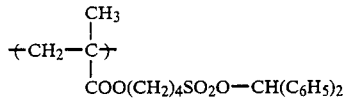 | 45,000 |

TABLE 5-continued

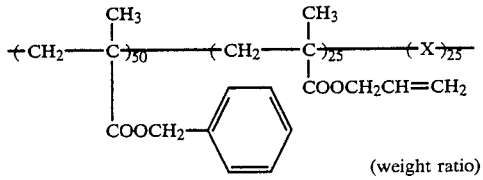

(weight ratio)

| Example No. | Resin No. | Co-monomer X | Weight Average Molecular Weight |
|---|---|---|---|
| 29 | VI | 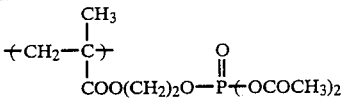 | 20,000 |
| 30 | VII | 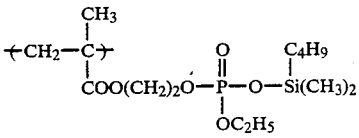 | 26,000 |
| 31 | VIII | 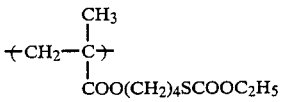 | 27,000 |
| 32 | IX | 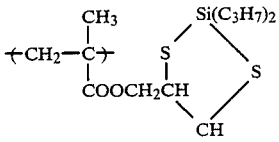 | 30,000 |
| 33 | X | 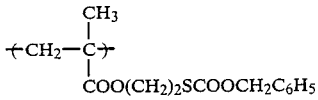 | 42,000 |
| 34 | XI | 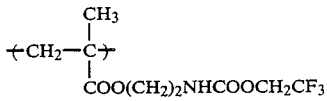 | 15,000 |
| 35 | XII | 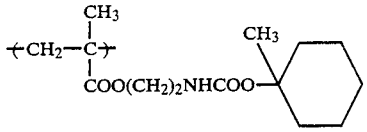 | 38,000 |
| 36 | XIII | 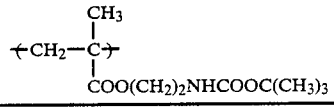 | 35,000 |

Each of these materials processed in the same manner as in Example 1, using the same processor. Next, the master plates thus prepared were etched to provide printing plates. All of the offset printing master plates had a density of 1.0 or more and a sharp image quality. Each of the printing plates thus prepared was used for printing to give 10,000 prints, all of which had a sharp image quality with no background fog.

EXAMPLES 37 TO 42

By following the same procedure as Example 25 except that copolymers shown in Table 6 were used in place of the Resin (I) of the invention, various electrophotographic photosensitive materials were prepared.

TABLE 6

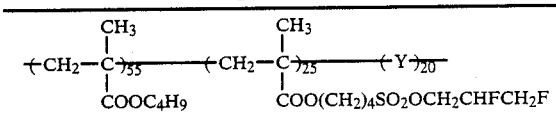

| Example No. | Resin No. | Co-monomer Y | Weight Average Molecular Weight |
|---|---|---|---|
| 37 | XIV | 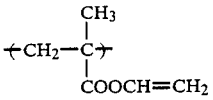 | 35,000 |
| 38 | XV | 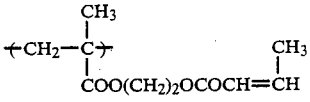 | 38,000 |
| 39 | XVI | 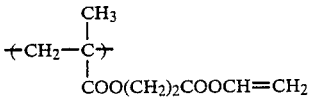 | 29,000 |
| 40 | XVII | 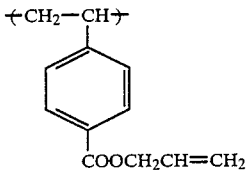 | 25,000 |
| 41 | XVIII | 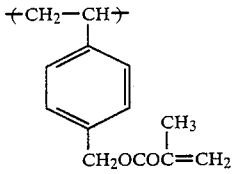 | 26,000 |
| 42 | XIX | 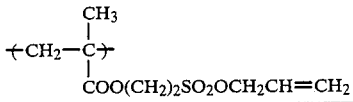 | 34,000 |

Each of these materials was processed in the same manner as in Example 1. Using the same processor. All the offset printing master plates thus prepared had a density of 1.0 or more and a sharp image quality. Next, each of the master plates was etched to provide a printing plate. Each of these plates thus prepared was used for printing to give 10,000 prints, all of which had a sharp image quality with no fog.

EXAMPLE 43

By following the same procedure as Example 25 except that butyl methacrylate/allyl methacrylate/acrylic acid (79/20/1, by weight) copolymer was used in place of the butyl methacrylate/acrylic acid copolymer in Example 25, a photosensitive material was prepared.

The material was processed in the same manner as in Example 1, using the same automatic camera processor ELP 404V. The offset printing master plate thus prepared and a density of 1.0 or more and a sharp image quality. Next, the master plate was etched to provide a printing plate. The plate thus prepared was used for printing to give 10,000 prints, all of which had a sharp image quality with no fog in the non-image areas.

As demonstrated above, according to the present invention an electrophotographic photosensitive material which gives less background stain of prints and has an extremely excellent printing durability is obtained.

While the invention has been described in detail and with reference to specific embodiments thereof, it will be apparent to one skilled in the art that various changes and modifications can be made therein without departing from the spirit and scope thereof.

What is claimed is:

1. An electrophotographic lithographic printing plate precursor having an electrophotographic photoreceptor which has at least one photoconductive layer containing a photoconductive zinc oxide and a resin binder on a conductive support, wherein the resin binder contains at least one resin, which has at least one functional group capable of forming at least one group selected from the group consisting of a thiol group, a phosphono group, an amino group and a sulfo group by decomposition upon treatment with an oil-desensitizing solution or dampening water and at least a part of which resin has been crosslinked.

2. An electrophotographic lithographic printing plate precursor as in cliam 1, wherein the resin binder contains at least one resin which contains at least one copolymer component having at least one functional group capable of forming at least one group selected from the group consisting of a thiol group, a phosphono group, an amino group and a sulfo group by decomposition and which has been crosslinked so that the resin is hardly soluble or insoluble in water when the said at least one functional group has been decomposed to form said thiol group, said phosphono group, said amino group, said sulfo group or a combination of said groups.

3. An electrophotographic lithographic printing plate precursor as in claim 1, wherein therein binder contains at least one resin which has at least one functional group capable of forming at least one group selected from the group consisting a thiol group, a phosphono group, an amino group and a sulfo group by decomposition and has at least one functional group capable of being hardened using heat, light or a combination thereof.

4. An electrophotographic lithographic printing plate precursor as in any one of claims 1 to 3, wherein said resin contains at least one functional group capable of forming at least one thiol group by decomposition and represented by the following formula (I):

$$(-S-L^A) \qquad \text{(I)}$$

wherein $L^A$ represents $-\overset{R^{A1}}{\underset{R^{A3}}{Si}}-R^{A2}$, $-\underset{O}{\underset{\|}{C}}-R^{A4}$, $-\underset{S}{\underset{\|}{C}}-R^{A5}$, $-\underset{O}{\underset{\|}{C}}-O-R^{A6}$, $-\underset{S}{\underset{\|}{C}}-O-R^{A7}$, $-S-R^{A8}$, $-\underset{S}{\underset{\|}{C}}-N\begin{matrix}R^{A9}\\R^{A10}\end{matrix}$, $-\underset{O}{\underset{\|}{C}}-N\begin{matrix}R^{A9}\\R^{A10}\end{matrix}$, 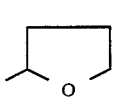 or 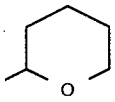 ;

wherein $R^{A1}$, $R^{A2}$, and $R^{A3}$, which may be the same or different, each represents a hydrocarbon group or $-O-R^{A'}$, wherein $R^{A'}$ represents a hydrocarbon group; and $R^{A4}$, $R^{A5}$, $R^{A6}$, $R^{A7}$, $R^{A8}$, $R^{A9}$, and $R^{A10}$ independently represent a hydrocarbon group.

5. An electrophotographic lithographic printing plate precursor as in any one of claims 1 to 3, wherein said resin contains at least one functional group capable of forming at least one thiol group by decomposition and represented by the following thiirane ring (II) and (III):

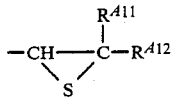

(II)

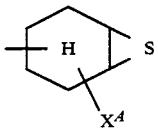

(III)

where $A^{A11}$ and $R^{A12}$ may be the same or different and each represents a hydrogen atom or a hydrocarbon group; and $X^A$ represents a hydrogen atom or an aliphatic group.

6. An electrophotographic lithographic printing plate precursor as in any one of claims 1 to 3, wherein said resin contains at least one functional group capable of forming at least one thiol group by decomposition and represented by the following formula (IV):

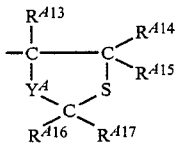

(IV)

wherein $Y^A$ represents an oxygen atom or —NH—; $R^{A13}$, $R^{A14}$ and $R^{A15}$ may be the same or different and each represents a hydrogen atom or a hydrocarbon group; and $R^{A16}$ and $R^{A17}$ may be the same or different and each represents a hydrogen atom, a hydrocarbon group or $-O-R^{A''}$ wherein $R^{A''}$ represents a hydrocarbon group.

7. An electrophotographic lithographic printing plate precursor as in any one of claims 1 to 3, wherein said resin contains at least one functional group capable of forming at least one thiol group by decomposition and represented by the following formula (V), (VI) or (VII):

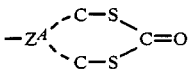

(V)

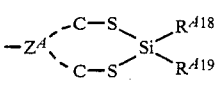

(VI)

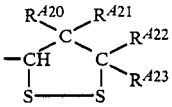

(VII)

wherein $Z^A$ represents an optionally hetero atom-interrupted carbon-carbon linkage or represents a chemical bond directly bonding the two C-S bonds in the formulae, provided that the number of the atoms between the sulfur atoms is 4 or less, and one of the —($Z^A$ . . . C)— bonds may represent a mere bond; $R^{A18}$ and $R^{A19}$ may be the same or different and each represents a hydrogen atom, a hydrocarbon atom or —A—$R^{A''}$, wherein $R^{A''}$ represents a hydrocarbon group; and $R^{A20}$, $R^{A21}$, $R^{A22}$ and $R^{A23}$ may be the same or different and each represents a hydrogen atom or a hydrocarbon group.

8. An electrophotographic lithographic printing plate precursor as in any one of claims 1 to 3, wherein said resin contains at least one functional group capable of forming at least one phosphono group by decomposition and represented by the following formula (VIII) or (IX):

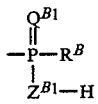

(VIII)

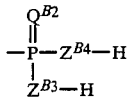

(IX)

where $R^B$ represents a hydrocarbon group or —$Z^{B2}$—$R^{B'}$, where $R^{B'}$ represents a hydrocarbon group; and $Z^{B2}$ represents an oxygen atom or a sulfur atom; $Q^{B1}$ represents an oxygen atom or a sulfur atom; $Z^{B1}$ represents an oxygen atom or a sulfur atom; and $Q^{B2}$, $Z^{B3}$ and $Z^{B4}$ independently represent an oxygen atom or a sulfur atom.

9. An electrophotographic lithographic printing plate precursor as in claim 8, wherein said functional group in said resin forms at least one phosphono group represented by the following formula (X) or (XI):

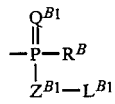

(X)

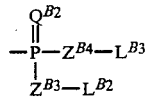

(XI)

where $Q^{B1}$, $Q^{B2}$, $Z^{B1}$, $Z^{B3}$, $Z^{B4}$ and $R^B$ have the same meanings as those in the formulae (VIII) and (IX): and $L^{B1}$, $L^{B2}$ and $L^{B3}$ independently represent

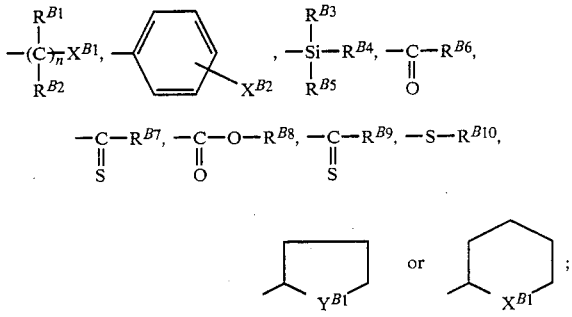

$R^{B1}$ and $R^{B2}$ may be the same or different and each represents a hydrogen atom, a halogen atom or methyl group; $X^{B1}$ and $X^{B2}$ each represents an electron-attracting group; n represents 1 or 2; $R^{B3}$, $R^{B4}$ and $R^{B5}$ may be the same or different and each represents a hydrogen atom, an optionally substituted linear or branched alkyl group having from 1 to 18 carbon atoms, an optionally substituted alicyclic group, an optionally substituted aralkyl group having from 7 to 12 carbon atoms, an optionally substituted aromatic group or —O—$R^{B'''}$, wherein $R^{B'''}$ represents a hydrocarbon group; $R^{B6}$, $R^{B7}$, $R^{B8}$, $R^{B9}$ and $R^{B10}$ independently represent a hydrocarbon group; and $Y^{B1}$ and $Y^{B2}$ each represents an oxygen atom or a sulfur atom.

10. An electrophotographic lithographic printing plate precursor as in any one of claims 1 to 3, wherein said resin contains at least one functional group capable of forming at least one amino group by decomposition and represented by the following formula (XII), (XIII) or (XIV):

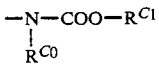

(XII)

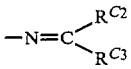

(XIII)

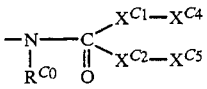

(XIV)

wherein $R^{C0}$ represents a hydrogen atom, an optionally substituted alkyl group having from 1 to 12 carbon atoms, an alicyclic group having from 5 to 8 carbon atoms, an optionally substituted aralkyl group having from 7 to 12 carbon atoms or an optionally substituted aryl group having from 6 to 12 carbon atoms; $R^{C1}$ represents an optionally substituted aliphatic group having from 2 to 12 carbon atoms; $R^{C2}$ and $R^{C3}$ may be the same or different and each represents a hydrocarbon group having from 1 to 12 carbon atoms; $X^{C1}$ and $X^{C2}$ may be the same or different and each represents an oxygen atom or a sulfur atom; and $X^{C4}$ and $X^{C5}$ may be the same or different and each represents a hydrocarbon group having from 1 to 8 carbon atoms.

11. An electrophotographic lithographic printing plate precursor as in any one of claims 1 to 3, wherein said resin contains at least one functional group capable of forming at least one sulfo group by decomposition and represented by the following formula (XVI) or (XVII):

$$-SO_2-O-R^{D1} \quad \text{(XVI)}$$

$$-SO_2-S-R^{D2} \quad \text{(XVII)}$$

where $R^{D1}$ represents

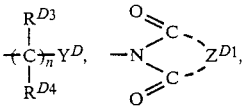

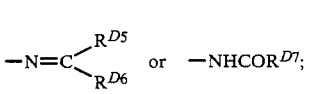

$R^{D2}$ represents an optionally substituted aliphatic group having from 1 to 18 carbon atoms or an optionally substituted aryl group having from 6 to 22 carbon atoms; $R^{D3}$ and $R^{D4}$ may be the same or different and each represents a hydrogen atom, a halogen atom, an alkyl group having from 1 to 6 carbon atoms or an aryl group having from 6 to 12 carbon atoms; Y represents an optionally substituted alkyl group having from 1 to 18 carbon atoms, an optionally substituted alkenyl group having from 2 to 18 carbon atoms, an optionally substituted aryl group having from 6 to 12 carbon atoms or —CO—$R^{D8}$, where $R^{D8}$ represents an aliphatic group or an aromatic group; n represents 0, 1 or 2; $Z^D$ represents an organic residue to form a cyclic imido group; $R^{D5}$ and $R^{D6}$ may be the same or different and each represents a hydrogen atom, an aliphatic group or an aryl group, provided that both $R^{D5}$ and $R^{D6}$ are not hydrogens at the same time: $R^{D7}$ represents an aliphatic group or an aromatic group.

12. An electrophotographic lithographic printing plate precursor as in claim 2, wherein said resin has a molecular weight of from $5\times10^3$ to $5\times10^5$.

13. An electrophotographic lithographic printing plate precursor as in claim 1, wherein said functional groups is contained in an amount of from about 1 to about 85 wt % based on the total weight of the resin binders.

14. An electrophotographic lithographic printing plate precursor as in claim 2, wherein said copolymer component having a cross-linking structure is present in an amount of from 0.1 to about 10 wt %, when the copolymer component contains polymerizable double bonds, or in an amount of from 1 to 80 wt %, when the copolymer component cross-linkable groups other than the polymerizable double bonds.

* * * * *